US009592691B1

(12) United States Patent
Regelsberger et al.

(10) Patent No.: US 9,592,691 B1
(45) Date of Patent: Mar. 14, 2017

(54) COLOR REGISTRATION ERROR CORRECTION USING PAGE COUNT

(71) Applicant: Eastman Kodak Company, Rochester, NY (US)

(72) Inventors: Matthias H. Regelsberger, Rochester, NY (US); Christopher B. Liston, Rochester, NY (US)

(73) Assignee: EASTMAN KODAK COMPANY, Rochester, NY (US)

( * ) Notice: Subject to any disclaimer, the term of this patent is extended or adjusted under 35 U.S.C. 154(b) by 0 days.

(21) Appl. No.: 14/847,263

(22) Filed: Sep. 8, 2015

(51) Int. Cl.
*B41J 29/393* (2006.01)

(52) U.S. Cl.
CPC ..... *B41J 29/393* (2013.01)

(58) Field of Classification Search
CPC . B41J 11/007; B41J 11/42; B41J 13/26; B41J 29/38; B41J 2/165; B41J 29/393; B65H 9/00; B65H 9/08; B65H 9/10; B65H 9/002; B65H 9/004; B65H 9/006; B65H 9/008; H04N 1/60; H04N 1/50; H04N 1/62; H04N 1/54; G06K 9/6203; G06K 19/06075; G06K 15/129; G06K 15/1807; G06K 15/1886
See application file for complete search history.

(56) References Cited

U.S. PATENT DOCUMENTS 5,859,711 A * 1/1999 Barry ..... B41J 29/393 358/1.15
8,649,052 B2 * 2/2014 Hoover ..... B41J 3/60 358/1.13
8,760,712 B2 6/2014 Enge et al.
8,845,059 B2 9/2014 Enge et al.
9,010,900 B1 4/2015 Armbruster et al.
9,016,822 B1 4/2015 Armbruster et al.
9,016,823 B1 4/2015 Armbruster et al.
9,016,824 B1 4/2015 Armbruster et al.
9,033,445 B1 5/2015 Armbruster et al.
9,094,643 B2 7/2015 Armbruster et al.
9,120,634 B1 9/2015 Muir et al.
2002/0181986 A1 * 12/2002 Castano ..... B41J 29/393 400/74

(Continued)

*Primary Examiner* — Matthew Luu
*Assistant Examiner* — Patrick King
(74) *Attorney, Agent, or Firm* — Kevin E. Spaulding

(57) ABSTRACT

A method for correcting image plane registration errors for a multi-channel printing system that prints documents of a particular document-type classification having a variable number of pages. An image plane registration error database stores image plane registration error information characterizing image plane registration errors as a function of page number for each of a plurality of different page-count classifications. A page-count classification is determined for a document to be printed, and image plane registration correction values are determined for each page based on the stored image plane registration error information associated with the determined page-count classification, wherein the image plane registration correction values for each page are determined based on the stored image plane registration error information for the corresponding page number. The image data for each document page of the document is then printed responsive to the corresponding image plane registration correction values.

23 Claims, 15 Drawing Sheets

(56) References Cited

U.S. PATENT DOCUMENTS

| | | | | |
|---|---|---|---|---|
| 2008/0006992 | A1* | 1/2008 | Inoue | B65H 9/002 271/228 |
| 2009/0185204 | A1* | 7/2009 | Wu | H04N 1/60 358/1.9 |
| 2011/0175280 | A1* | 7/2011 | Tharayil | B65H 7/06 271/227 |
| 2013/0113857 | A1 | 5/2013 | Armbruster et al. | |
| 2014/0146331 | A1* | 5/2014 | Sato | H04N 1/6097 358/1.9 |
| 2015/0023712 | A1* | 1/2015 | Kawabata | G03G 15/6561 399/394 |
| 2015/0116783 | A1* | 4/2015 | Numata | H04N 1/00411 358/3.27 |

* cited by examiner

COLOR REGISTRATION ERROR CORRECTION USING PAGE COUNT

CROSS REFERENCE TO RELATED APPLICATIONS

Reference is made to commonly-assigned U.S. patent application Ser. No. 14/447,655, filed Jul. 31, 2014, entitled: "Improving document registration using registration error model", by Armbruster et al., issued as U.S. Pat. No. 9,213,287; to commonly-assigned, U.S. patent application Ser. No. 14/447,661, filed Jul. 31, 2014, entitled "Reducing registration errors using registration error model," by Wozniak et al., issued as U.S. Pat. No. 9,162,475; to commonly assigned, co-pending U.S. patent application Ser. No. 14/447,669, filed Jul. 31, 2014, entitled: "Controlling a printer using an image region database", by Sreekumar et al. (published as U.S. 2016/0031245); to commonly assigned, U.S. patent application Ser. No. 14/447,680, filed Jul. 31, 2014, entitled: "Controlling an electrophotographic printer using an image region database", by Sreekumar et al., issued as U.S. Pat. No. 9,250,595; to commonly assigned, co-pending U.S. patent application Ser. No. 14/447,686, filed Jul. 31, 2014, entitled: "Controlling a web-fed printer using an image region database", by Sreekumar et al. (published as U.S. 2016/0031246); each of which is incorporated herein by reference.

FIELD OF THE INVENTION

The present invention generally relates to inkjet printing systems and more particularly to performing color-to-color registration correction in an inkjet printing system.

BACKGROUND OF THE INVENTION

In a digitally controlled printing system, a print medium is directed through a series of components. The print medium can be cut sheet or a continuous web. As the print medium moves through the printing system, a printing material such as a liquid (e.g., ink) or dry powder (e.g., toner), is applied to the print medium by one or more print stations to produce a multi-color output on paper or plastic. In other applications, the print stations in a printing system can be used to produce an electrical circuit (e.g., flex-circuits or touch panels), by applying conductive or insulating materials to a substrate.

In commercial inkjet printing systems, the print stations include multiple printheads that jet ink onto the print medium as the print medium is physically moved through the printing system at a high rate of speed (e.g., 1000 feet/minute). A reservoir containing ink or some other material is usually behind each nozzle plate in a print station. The ink streams through the nozzles in the nozzle plates when the reservoirs are pressurized. The jettable liquid is applied to the print medium as it passes by the print station by applying a control signal to each nozzle to jet a small amount of liquid (drops) such as an ink onto the print medium to form a single picture element commonly referred to as a "pixel." Print stations typically contain nozzle arrays at 600 nozzles/inch capable of printing 600 dots/inch. The nozzle arrays are arranged within each print station across the full width of the print medium. Repeated jetting of ink (controlled by the control signals applied to each nozzle) will produce individual picture elements (pixels) in the direction of the print medium movement. The timing for the nozzle control signals is typically linked to the speed of the print medium such that a constant distance (e.g., 1/600 inch) between successive pixels on print medium is achieved even while the printing process is changing speed.

In the print stations of commercial electrophotographic printing systems, a photoconductive drum or belt is first electrostatically charged. When the photoconductor is selectively exposed to light, typically from a light modulated scanned laser beam or an array of LEDs, the exposed regions become conductive, causing the charge to be depleted from those regions of the photoconductor. In the development stage, charged toner particles are attracted to the charged portions of the photoconductor (i.e., the portions that have not been exposed to light). The toner image is then transferred to the print medium, either directly or via an intermediate transfer substrate. The toner is then fused to the print medium using a combination of heat and pressure.

The printheads in each print station in commercial printing systems typically print only one color. A print station is provided for each colored ink to print color image content. For example, many printing system include four print stations for printing cyan, magenta, yellow and black inks. The print content is formed by printing the colored inks sequentially, one image plane at a time, each image plane using only one type of colorant. In the example of a four color print, all four image planes together on a single page form the print content. The content printed by an individual print station is sometimes referred to as an image plane.

Similarly, the production of a three-layer electrical circuit, such as a touch panel, requires a print system with three print station (e.g., a conducting material, followed by an insulating material, followed by another conductive material). The print content of a three-layer conductive circuit is formed on the substrate by printing the conducting, insulating and conducting inks sequentially, one image plane at a time. In the example of a three-layer circuit, all three image planes together on a single page form the printed content.

For multi-color image content or the proper function of the printed circuit, the image planes on each page need to be aligned, or registered with each other so that the overlapping ink colors produce a quality multi-color image or a quality multi-layer electrical circuit.

Color registration errors can be partitioned into different types. Examples of color registration errors include, but are not limited to, an image plane (i.e., color plane) having a linear translation with respect to another image plane, an image plane being rotated with respect to another image plane, an image plane skewed with respect to another image plane forming a trapezoidal shape and an image plane being stretched, contracted, or both stretched and contracted in different regions or in different directions with respect to another image plane.

There are several variables that contribute to the registration errors in image plane alignment including physical properties of the print medium, conveyance of print medium, ink application system, ink coverage, and drying of ink. Color registration errors are typically managed by controlling these variables. However, controlling these variables can often restrict the range of desired print applications. For example, image plane to image plane registration errors will typically become larger than desired as paper weight for the print application is reduced, when ink coverage is increased, or when the amount of ink coverage becomes more variable between printed documents. These limitations compromise the range of suitable applications for inkjet printing systems. Therefore, there exists a need to characterize registration errors during the printing process in real-time and develop the means to correct the individual pixel placement for each image plane (real-time), so that registration errors between image planes are minimized during the printing process.

SUMMARY OF THE INVENTION

The present invention represents a method for correcting image plane registration errors for a multi-channel printing system that prints documents, each document including a set of document pages having associated page numbers, each document page having associated image data for a plurality of image planes, includes:

designating an image plane registration error database associated with a particular document-type classification to be used in correcting image plane registration errors, the image plane registration error database storing image plane registration error information characterizing image plane registration errors as a function of page number for each of a plurality of different page-count classifications, wherein the page-count classification corresponds to the number of document pages in the document;

receiving a new document of the particular document-type classification;

determining a page-count classification for the new document corresponding to the number of document pages in the new document;

determining image plane registration correction values for each document page of the new document based on the stored image plane registration error information associated with the determined page-count classification, wherein the image plane registration correction values for each document page of the new document are determined based on the stored image plane registration error information for the corresponding page number; and using the multi-channel printing system to print the image data for each document page of the new document responsive to the corresponding determined image plane registration correction values.

This invention has the advantage that repetitive registration errors associated with a particular document type can be corrected, even when the documents may have different numbers of pages.

It has the additional advantage that the registration corrections can also be corrected responsive to the other attributes such as a history sub-classification, a print-lane sub-classification or an image-content sub-classification.

Figure 1:
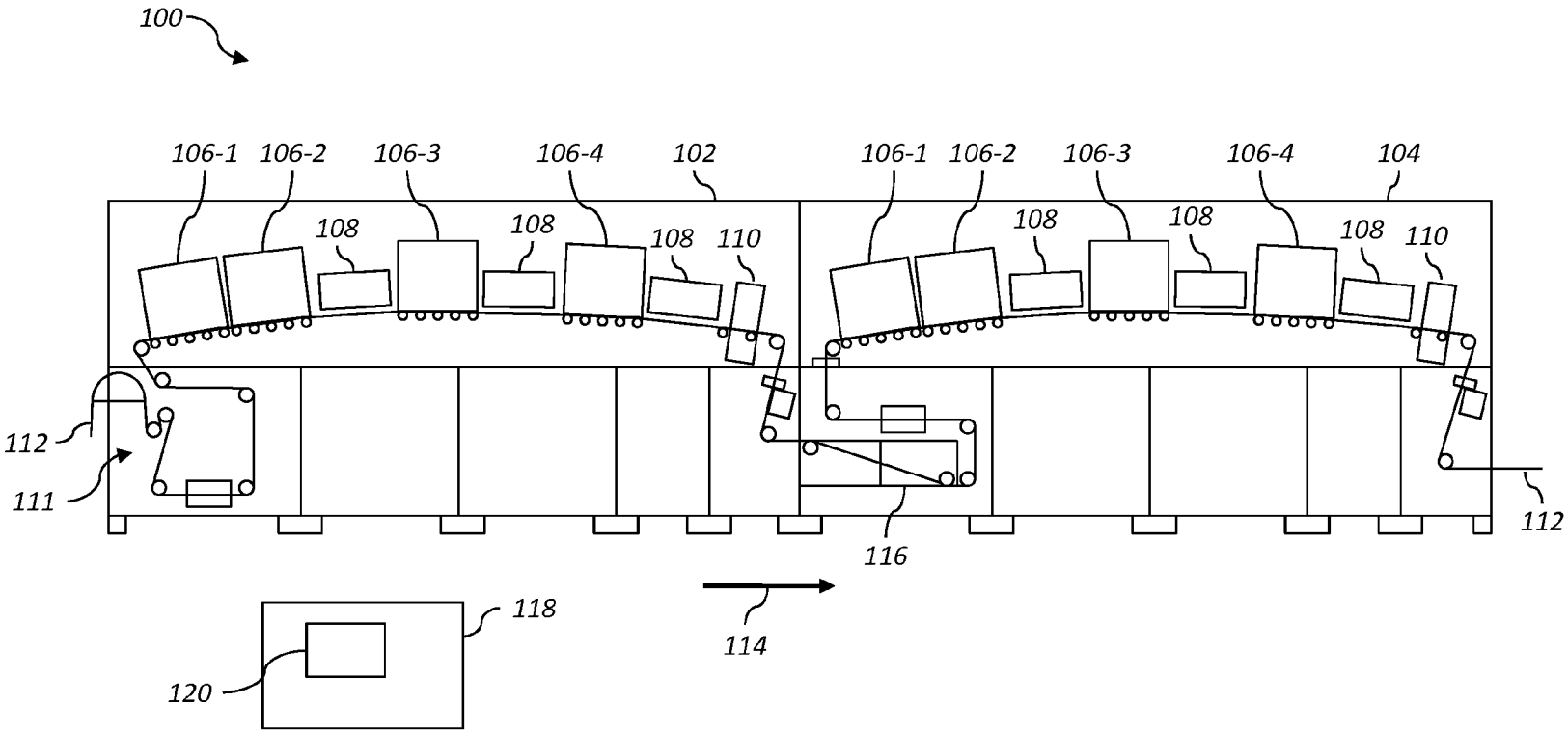
FIG. 1 is a schematic of a continuous-web inkjet printing system.

It is to be understood that the attached drawings are for purposes of illustrating the concepts of the invention and may not be to scale.

DETAILED DESCRIPTION OF THE INVENTION

The invention is inclusive of combinations of the embodiments described herein. References to "a particular embodiment" and the like refer to features that are present in at least one embodiment of the invention. Separate references to "an embodiment" or "particular embodiments" or the like do not necessarily refer to the same embodiment or embodiments; however, such embodiments are not mutually exclusive, unless so indicated or as are readily apparent to one of skill in the art. The use of singular or plural in referring to the "method" or "methods" and the like is not limiting. It should be noted that, unless otherwise explicitly noted or required by context, the word "or" is used in this disclosure in a non-exclusive sense.

Throughout the specification and claims, the following terms take the meanings explicitly associated herein, unless the context clearly dictates otherwise. The meaning of "a," "an," and "the" includes plural reference, the meaning of "in" includes "in" and "on." Additionally, directional terms such as "on", "over", "top", "bottom", "left", "right" are used with reference to the orientation of the figure(s) being described. Because components of aspects of the present invention can be positioned in a number of different orientations, the directional terminology is used for purposes of illustration only and is in no way limiting.

The present description will be directed in particular to elements forming part of, or cooperating more directly with, a system in accordance with the present invention. It is to be understood that elements not specifically shown, labeled, or described can take various forms well known to those skilled in the art. In the following description and drawings, identical reference numerals have been used, where possible, to designate identical elements. It is to be understood that elements and components can be referred to in singular or plural form, as appropriate, without limiting the scope of the invention.

The example aspects of the present invention are illustrated schematically and not to scale for the sake of clarity. One of ordinary skill in the art will be able to readily determine the specific size and interconnections of the elements of the example aspects of the present invention.

As described herein, the example aspects of the present invention are applied to image plane registration in inkjet printing systems. However, many other applications are emerging which use inkjet printheads or similar nozzle arrays to emit other types of fluids that need to be finely metered and deposited with high spatial precision. The fluids applied using inkjet printing systems include inks, both water-based and solvent-based, that include one or more colorants (e.g., dyes or pigments). The fluids can also include various substrate coatings and treatments, various medicinal materials, and functional materials useful for forming, for example, various circuitry components or structural components. In addition, a nozzle array can jet out gaseous material or other fluids. As such, as described herein, the terms "liquid", "ink" and "inkjet" refer to any material that is ejected by a nozzle array. For simplicity and clarity of description, the invention will be described in terms of a multi-color printer. It must be understood that the invention similarly applies to other applications such as the printing of multiple layers of an electronic circuit where the individual circuit layers would correspond to an image plane in the multi-color printer. In such applications, registration of the individual layers must be maintained for proper operation of the electronic circuit in a similar manner to the registration of the color image planes in the color prints. It is anticipated that many other applications may be developed in which the invention may be employed to enhance the registration of a set of image planes. The term "multi-channel printing system" will be used to encompass not only multi-color printers but also printing systems for other applications in which the printing system includes multiple channels or printheads, each of which print a corresponding image plane of the documents, and in which the multiple printed image planes of the documents are to be aligned or registered to each other.

Inkjet printing is commonly used for printing on paper. However, printing can occur on any substrate or receiving medium. For example, vinyl sheets, plastic sheets, glass plates, textiles, paperboard, and corrugated cardboard can comprise the print medium. Additionally, although the term inkjet is often used to describe the printing process, the term jetting is also appropriate wherever ink or other fluid is applied in a consistent, metered fashion, particularly if the desired result is a thin layer or coating.

Inkjet printing is a non-contact application of an ink or some other fluid to a print medium. Typically, inkjet printers use one of two types of jetting mechanisms are used and are categorized by the jetting technology as either drop-on-demand inkjet or continuous inkjet. The first technology, "drop-on-demand" inkjet printing, provides ink drops that impact upon a recording surface using a pressurization actuator, for example, a thermal, piezoelectric, or electrostatic actuator. One commonly practiced drop-on-demand technology uses thermal actuation to eject ink drops from a nozzle. A heater, located at or near the nozzle, heats the ink sufficiently to boil, forming a vapor bubble that creates enough internal pressure to eject an ink drop. This form of inkjet is commonly termed "thermal inkjet."

The second technology commonly referred to as "continuous" inkjet printing, uses a pressurized ink source to produce a continuous liquid jet stream of ink by forcing ink, under pressure, through a nozzle. The stream of ink is perturbed using a drop forming mechanism such that the liquid jet breaks up into drops of ink in a predictable manner. One continuous printing technology uses thermal stimulation of the liquid jet with a heater to form drops that eventually become print drops and non-print drops. Printing occurs by selectively deflecting drops so that print drops reach the print medium and non-print drops are caught by a collection mechanism. Various approaches for selectively deflecting drops have been developed including electrostatic deflection, air deflection, and thermal deflection.

Additionally, there are typically two formats of print medium used with inkjet printing systems. The first format is commonly referred to as a "continuous web" while the second format is commonly referred to as "cut sheet." The continuous web of print medium refers to a continuous strip of print medium, generally originating from a source roll. The continuous web of print medium is moved relative to the inkjet printing system components via a web transport system, which typically includes drive rollers, web guide rollers, and web tension sensors. Cut sheets refer to individual sheets of print medium that are moved relative to the inkjet printing system components via a transport mechanism (e.g., rollers and drive wheels or a conveyor belt system) that is routed through the inkjet printing system.

The invention described herein is applicable to both formats of printing technologies. As such, the terms print station and printhead, as used herein, are intended to be generic and not specific to either technology. Additionally, the invention described herein is applicable to both print medium formats. As such, the terms print medium, and web, as used herein, are intended to be generic and not intended to be limiting as to the type of print medium or the way in which the print medium is moved through the printing system. Additionally, the terms print station, printhead, print medium, and web can be applied to other nontraditional inkjet applications, such as printing conductors on plastic sheets.

Although the invention is described by way of example as applying to inkjet printing systems, aspects of the present invention are also applicable to image plane registration in electrophotography printing systems. In the print stations of commercial electrophotography printing systems, a photoconductive drum or belt is first electrostatically charged. When the photoconductor is selectively exposed to light, typically from a light modulated scanned laser beam or an array of LEDs, the exposed regions become conductive, causing the charge to be depleted from those regions of the photoconductor. In the development stage, charged toner particles are attached to the charged portions of the photoconductor, which hadn't been exposed to light. The toner image is then transferred either directly to the print medium or via an intermediate transfer substrate to the print medium. The toner is then fused to the print medium, by a combination of heat and pressure. To simplify the description, the term ink is intended to also include both wet and dry toners that can be applied to the print medium by means of an electrophotography process.

The terms "color plane", "image plane", "color separation", and "image separation" are used generically and interchangeably herein to refer to a portion of the data that is used to specify the location of features that are made by a particular print station of a digitally controlled printing system on the print medium. Similarly, "color-to-color registration" is used generically herein to refer to the registration of such features that are made by different print stations on the print medium. For color printing of images, the patterns of dots printed by different print stations in printing the same or different colors must be registered with each other to provide a high quality image. An example of a non-color printing application is functional printing of a circuit. The patterns of dots printed by different print stations, the image planes, form directly or serve as catalysts or masks for the formation of different layers of deposited conductive materials, semiconductor materials, resistive materials, insulating materials of various dielectric constants, high permeability magnetic materials, or other types of materials, must also be registered to provide a properly functioning circuit. The terms image plane and color-to-color registration can also be used herein to refer to the mapping and registration of pre-print or finishing operations, such as the mapping of where the folds or cutting or slitting lines are, or the placement of vias in an electrical circuit.

The terms "upstream" and "downstream" are terms of art referring to relative positions along the transport path of the print medium; points on the transport path move from upstream to downstream. In the following figures, a print medium 112 moves along a transport path from upstream to downstream in a transport direction 114. Where they are used, terms such as "first," "second," and so on, do not necessarily denote any ordinal or priority relation, but are simply used to more clearly distinguish one element from another.

The schematic side view of FIG. 1 shows an example of a continuous web inkjet printing system 100. Printing system 100 includes a first print module 102 and a second print module 104, each of which includes lineheads 106-1, 106-2, 106-3, 106-4, dryers 108, and a quality control sensor 110. Each linehead 106-1, 106-2, 106-3, 106-4 typically includes multiple printheads (not shown) that apply ink or another fluid (gas or liquid) to the surface of the print medium 112 that is adjacent to the printheads. In the illustrated configuration, each linehead 106-1, 106-2, 106-3, 106-4 applies a different colored ink to the surface of the print medium 112 that is adjacent to the lineheads 106-1, 106-2, 106-3, 106-4. By way of example only, linehead 106-1 applies cyan colored ink, linehead 106-2 magenta colored ink, linehead 106-3 yellow colored ink, and linehead 106-4 black colored ink. The portion of the transport path in each print module 102, 104 from the first linehead 106-1 through the last linehead 106-4 is called a "print zone."

The printing system 100 also include a web tension system 111 (portions of which are shown in FIG. 1) that serves to move the print medium 112 through the printing system 100 in a controlled fashion along the transport path in the transport direction 114 (generally left-to-right as in FIG. 1). The print medium 112 enters the first print module 102 from a source roll (not shown) and the lineheads 106-1, 106-2, 106-3, 106-4 of the first print module 102 apply ink to one side of the print medium 112. As the print medium 112 feeds into the second print module 104, a turnover module 116 is adapted to invert or turn over the print medium 112 so that the lineheads 106-1, 106-2, 106-3, 106-4 of the second print module 104 can apply ink to the other side of the print medium 112. The print medium 112 then exits the second print module 104 and is collected by a print medium receiving unit (not shown).

A processing system 118 can be connected to various components in the web tension system 111 and used to control the positions of the components, such as gimbaled or caster rollers. Processing system 118 can also be connected to the quality control sensors 110 and used to process images or data received from the quality control sensors 110. The processing system 118 can also be connected to components in printing system 100 using any known wired or wireless communication connection. Processing system 118 can be separate from printing system 100 or integrated within printing system 100 or within a component in printing system 100. In various embodiments, the processing system 118 can include a single processor, or can include a plurality of processors. Each of the one or more processors can be separate from the printing system 100 or integrated within the printing system 100.

A storage system 120 is connected to the processing system 118. The storage system 120 can store information for corrections image plane registration errors in accordance with the present invention of the invention. The storage system 120 can include one or more external storage devices; one or more storage devices included within the processing system 118; or a combination thereof. In some embodiments, the storage system 120 can include its own processor, and can have memory accessible by the one or more processors in the processing system 118. As will be discussed in more detail later, in accordance with embodiments of the invention, the storage system 120 can be used to store data useful for determining appropriate registration corrections for documents in a print job.

Figure 2:
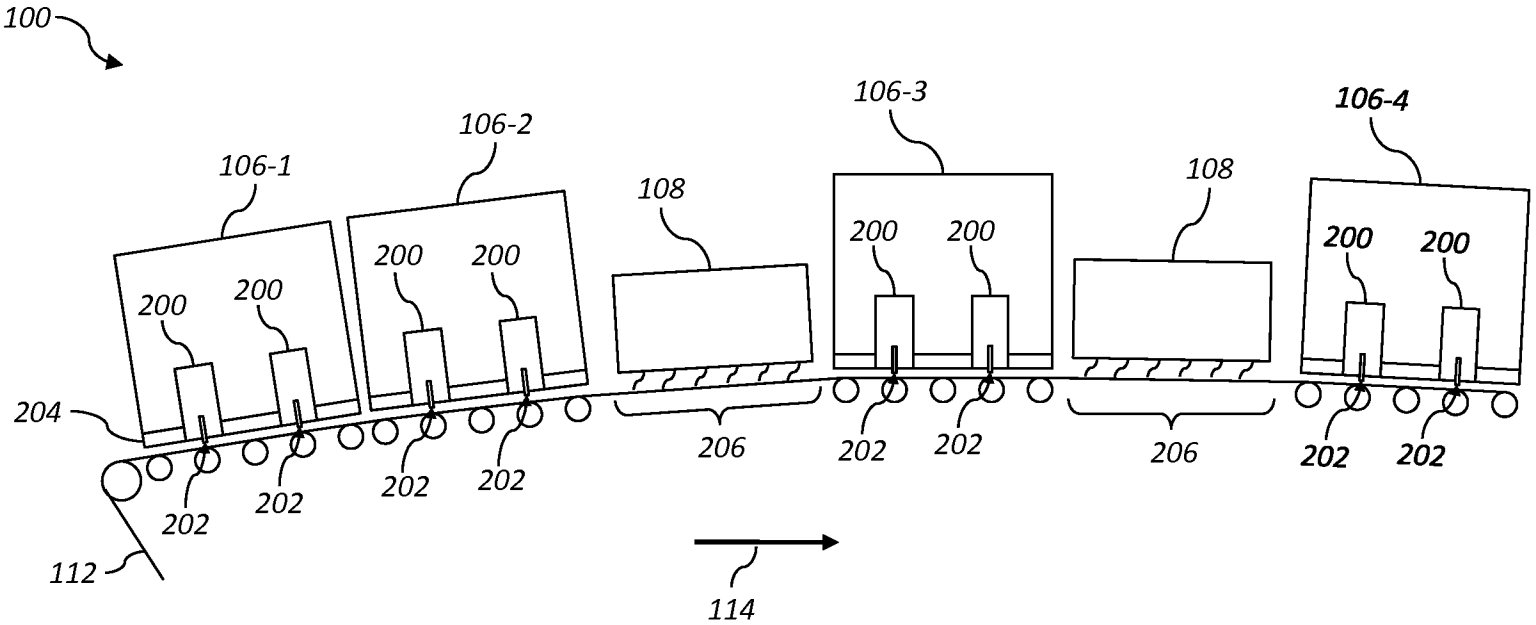
FIG. 2 is a schematic showing additional details for a portion of the printing system of FIG. 1.

FIG. 2 illustrates a portion of the printing system 100 in greater detail. As the print medium 112 is moved through printing system 100, the lineheads 106-1, 106-2, 106-3, 106-4, which typically include a plurality of individual printheads 200, apply ink or another fluid onto the print medium 112 via nozzle arrays 202 of the printheads 200. The printheads 200 within each linehead 106-1, 106-2, 106-3, 106-4 are located and aligned by a support structure 204 in the illustrated configuration. After the ink is jetted onto the print medium 112, the print medium 112 passes beneath the one or more dryers 108 which apply heat 206 or air to the ink on the print medium 112 to remove at least a portion of the moisture. For example, ink s typically include colorant particles in a carrier liquid. In this case, the dryer 108 is used to remove carrier liquid from the print medium 112.

Figure 3:
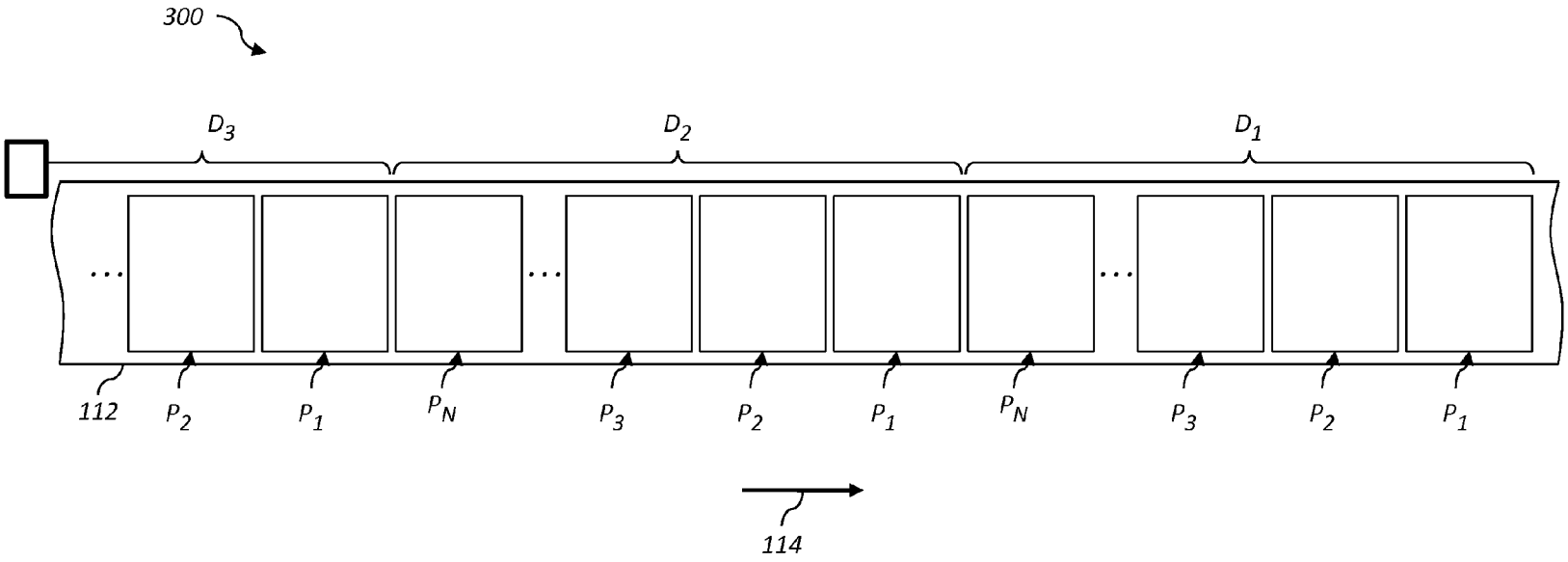
FIG. 3 illustrates a print job including a number of documents.

Referring now to FIG. 3, there is shown an example of a portion of a print job 300, including a number of documents ($D_1$, $D_2$, $D_3$ . . . ) printed on a web of print medium 112 traveling in a transport direction 114. Each document includes a set of N pages ($P_1$, $P_2$, $P_3$ . . . $P_N$). Each page can include any printed output such as, for example, text, graphics, or photos, individually or in various combinations. The pages are printed sequentially, starting with pages $P_1$-$P_N$ of the first document $D_1$, followed immediately by pages $P_1$-$P_N$ of the second document $D_2$, and continuing until the $N^{th}$ page of the final document is printed. As used herein, the term "print job" refers to a set of one or more documents to be printed at one time under consistent conditions (common inks and print medium). A "document" is a collection of pages intended to be collected together to form a unit. A "page" refers to a single side of print. In some cases, the pages are multi-color pages that are intended to be viewable by a human observer. In other cases, the pages can take other forms such as printed circuits. A set of set of related circuits that are printed on a sequence of pages can be referred to as a "document." For example, a set of touch screens that are intended for use in a particular produce (e.g., an automobile) can be printed as a sequence of document pages.

In the example of FIG. 3, each of the documents ($D_1$, $D_2$, $D_3$ . . . ) within the print job 300 is the same or substantially similar so that the ink coverage for a particular page is substantially the same within each of the documents. That is, the amount of each ink printed on the first page $P_1$ of each document is about the same, the amount of each ink printed on the second page $P_2$, may differ significantly from the ink coverage on the first page $P_1$, but is approximately the same for each document, and so on for each page in the documents. In some cases, the information to be printed in each document can have some variations. For example, if the documents are financial statements that are sent to multiple recipients, the name and address along with transaction information for each recipient can vary while maintaining the consistency of the page layout and overall ink coverage from one document to the next. Examples of documents that will generally have identical or similar content would include, but are not limited to, books, magazines, reports, and transactional documents.

The print job 300 depicted in FIG. 3 illustrates an arrangement where a single page is positioned across the width on the print medium 112. In other cases, multiple pages can be printed at different positions across the width of the print medium 112.

When the print job 300 is printed, the print medium 112 can receive varying amounts of ink in different image regions during printing. In turn, the aqueous component of the ink is absorbed into the print medium 112 and can cause the print medium 112 to swell and stretch, especially with water-based inks or in high ink laydown regions of the printed content (e.g., an image region with a dense black background), and if the print medium is under tension. The amount of stretch is typically higher in the direction of movement (i.e., the in-track or transport direction 114) than in the cross-track direction.

Additionally, drying of the print medium 112 can cause the print medium 112 to shrink. When the print medium 112 is heated in between print stations, regions of the print medium 112 can be stretched and shrunk one or more times as the print medium 112 moves through the printing system 100.

Printing with several image planes in which each color record is printed sequentially requires color-to-color registration of the image content. Unanticipated or unaccounted for stretch or shrink in the print medium 112 can produce a loss of color registration and can lead to blurry content or hue degradation. Additionally, printing on both sides of the print medium 112 usually requires front-to-back registration, and the second side of the print medium 112 is usually printed significantly later than the first side.

Figure 4:
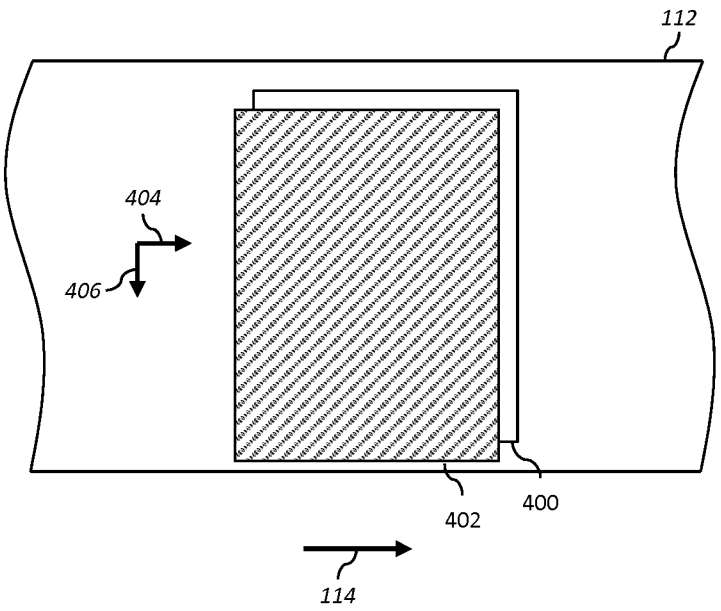
FIG. 4 illustrates a color registration error produced by the translation of one image plane relative to another image plane.

Translation is one type of color registration error. FIG. 4 depicts one example of cross-track and in-track color registration errors produced by the translation of one image plane relative to another image plane. Typically, one image plane (e.g., black) is used as a reference image plane 400 from which the color registration errors can be measured. In various embodiments, the reference image plane 400 can be the first image plane to be printed, the last image plane to be printed, or it can be printed at any other point in the sequence of printed image planes. Errors in registration for the remaining image planes can be determined by comparing each image plane to the reference image plane. In this example, the image content in image plane 402 is translated (i.e., shifted) with respect to the reference image plane 400. In the illustrated example, image plane 402 has color registration errors in both the in-track direction 404 and the cross-track direction 406.

Figure 5:
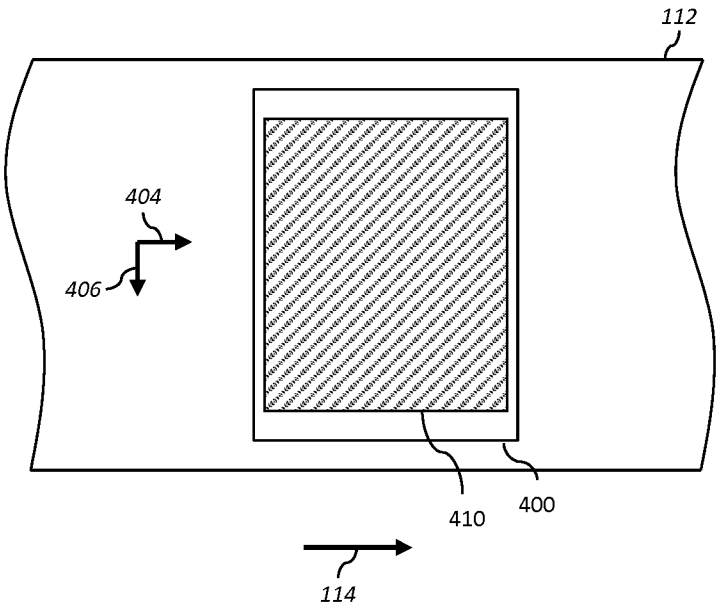
FIG. 5 illustrates a color registration error produced by the contraction or expansion of one image plane relative to another image plane.

Magnification errors (i.e., stretch and contraction errors) represent another type of color registration error. FIG. 5 depicts an example color registration errors caused by the stretch or contraction of one image plane relative to another image plane. The different image planes can be stretched or contracted by different amounts in the in-track direction 404 and the cross-track direction 406. In this example, image plane 410 is contracted in both the in-track direction 404 and the cross-track direction 406 with respect to the reference image plane 400.

Figure 6:
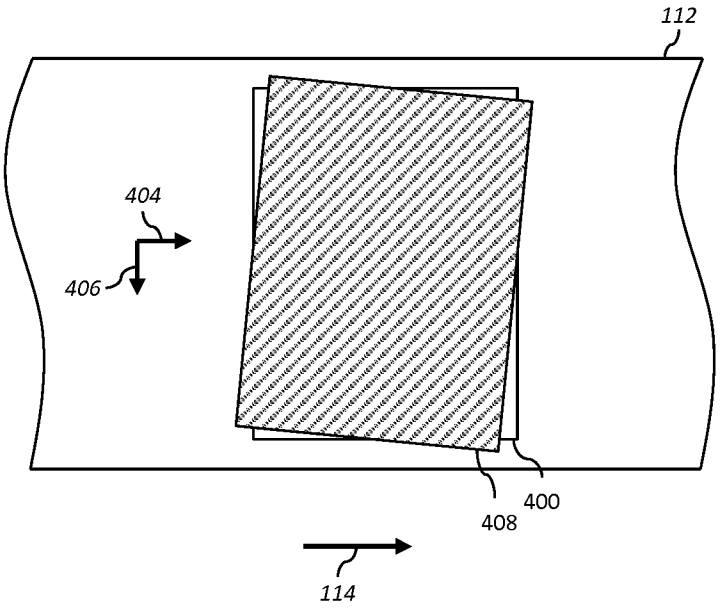
FIG. 6 illustrates a color registration error produced by the rotation of one image plane relative to another image plane.

Rotation is another type of color registration error. FIG. 6 depicts an example of registration errors resulting from the rotation of one image plane relative to another image plane. In this example, the image plane 408 is rotated with respect to the reference image plane 400. Rotation errors result in registration errors in both the in-track direction 404 and the cross-track direction 406.

Figure 7:
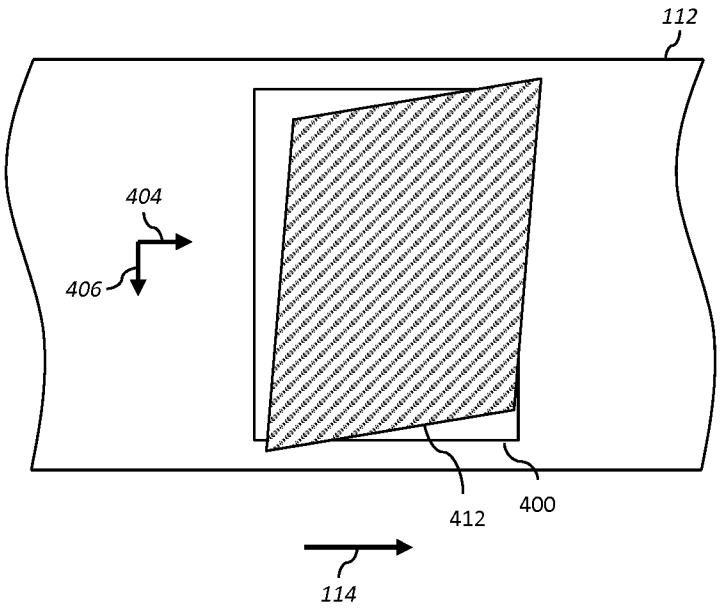
FIG. 7 illustrates a color registration error produced by a skewing of one image plane relative to another image plane.

Skew is another type of color registration error. FIG. 7 depicts an example of color registration errors caused by the skewing of one image plane relative to another image plane. In this example, image plane 412 is skewed with respect to the reference image plane 400, resulting in a parallelogram deformation of image plane 412. Skewing can be caused by the print medium 112 not passing under a print station in a direction perpendicular to the nozzle array axis. Skew registration errors can be viewed as a translation registration error where the amount of translation varies with position within the page.

Figure 8:
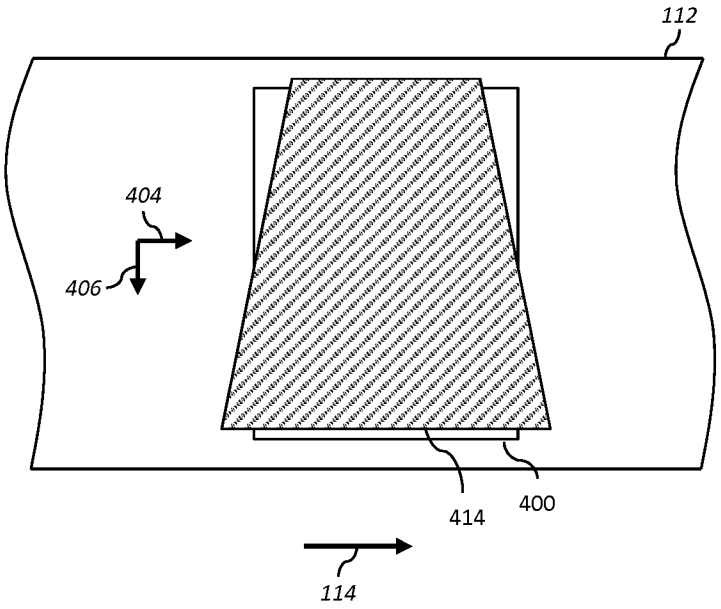
FIG. 8 illustrates a color registration error produced by a keystone distortion of one image plane relative to another image plane.

Keystone distortion is another type of color registration error. FIG. 8 depicts an example of color registration errors caused by keystone distortion of image plane 414 relative to the reference image plane 400. The keystone distortion can be produced by a non-uniform expansion or contraction of the print medium 112 between the printing of one image plane and another. Skew registration errors can be viewed as a stretch or contraction registration error where the amount of stretch or contraction varies with position within the page.

In general, the stretching or shrinking can occur in the in-track direction 404, the cross-track direction 406, or both the in-track direction 404 and the cross-track direction 406. In some cases, one image plane can contract in one direction (e.g., the cross-track direction 406) and stretch in the other direction (e.g., the in-track direction 404). These shifts and distortions need not be uniform across the document, and can vary linearly or non-linearly. As a result, certain regions of a document may exhibit expansion while other regions may exhibit no expansion, or may even show contraction. In some cases, the registration errors can include combinations of the types of color registration errors shown in FIGS. 4-8, or can include different types of color registration errors.

It has been observed that a significant portion of the color registration errors are consistent each time a copy of a document is printed. The repeating color registration errors can be specific to each page in the document, and even to particular regions within the individual pages. For example, in a document having a sequence of three pages which are repeatedly printed in sequential order, the color registration errors for the each of the three pages can be different from each other. However, the color registration errors in the second page can repeat each time the second page is printed, and the color registration errors in the third page can repeat each time the third page is printed. Furthermore within the second page, there can be regions of the page which exhibit one level of particular type of registration error that is consistently different than the corresponding registration error in a different region in the same page for each copy of the second page that is printed.

Various approaches have been proposed to correct for the repeatable registration errors that occur when printing multiple copies of a particular document (or similar documents). For example, the registration errors can be measured for a first copy of the document, and then corresponding corrections can be applied when subsequent copies of the document are printed. A number of such methods are described in commonly-assigned U.S. Pat. No. 9,010,900 (Armbruster et al.), entitled "Color-to-color correction in a printing system;" U.S. Pat. No. 9,016,822 (Armbruster et al.), entitled "Color-to-color correction in a printing system;" U.S. Pat. No. 9,016,823 (Armbruster et al.), entitled "Color-to-color correction in a printing system;" U.S. Pat. No. 9,016,824 (Armbruster et al.), entitled "Color-to-color correction in a printing system," U.S. Pat. No. 9,033,445 (Armbruster et al.), entitled "Color-to-color correction in a printing system;" and U.S. Pat. No. 9,094,643 (Armbruster et al.), entitled "Color-to-color correction in a printing system," each of which is incorporated herein by reference.

In a more general case, the printed output in each document can be substantially different from the printed content in the other documents in a print job 300. In such cases, the registration errors may be significantly different in each of the documents. To correct for these registration errors, more complex solutions are required to predict and correct for the registration errors.

Commonly-assigned, co-pending U.S. patent application Ser. No. 14/447,655 (Armbruster et al.), filed Jul. 31, 2014, entitled "Improving document registration using registration error model," which is incorporated herein by reference, teaches a method for correcting color registration errors for a print job including one or more documents having a plurality of image planes. A color registration error model is used to predict a color registration error value for a document as a function of ink coverage characteristics for the document, wherein the color registration error model is a parametric model having one or more parameters. An image plane correction value is determined based on the predicted color registration error, and the document is printed using the determined image plane correction value.

Commonly-assigned, co-pending U.S. patent application Ser. No. 14/447,661 (Wozniak et al.), filed Jul. 31, 2014, entitled "Reducing registration errors using registration error model," which is incorporated herein by reference, teaches a method for correcting color registration errors for a color printer that prints color image data on a continuous web of media. A color registration error model is used to predict a color registration error value for a particular in-track position as a function of ink coverage characteristics for an image region including the particular in-track position, wherein the color registration error model is a parametric model having one or more parameters. An image plane correction value is determined based on the predicted color registration error, and the color image data for the particular in-track position is printed using the determined image data correction values.

Commonly assigned, co-pending U.S. patent application Ser. No. 14/447,669, (Sreekumar et al.), filed Jul. 31, 2014, entitled "Controlling a printer using an image region database," which is incorporated herein by reference, teaches a method for controlling a digital printing system to print digital image data for an image region. An image region database stores data characterizing a plurality of reference image regions, each reference image region having one or more associated system control parameters that are appropriate for use in printing the reference image region. The system control parameters can include parameters related to correcting color registration errors. The image region to be printed is compared with the reference image regions in the image region database, and a similar reference image region is selected. The image region is printed using the system control parameters associated with the selected similar reference image region.

Commonly assigned, co-pending U.S. patent application Ser. No. 14/447,680, (Sreekumar et al.), filed Jul. 31, 2014, entitled "Controlling an electrophotographic printer using an image region database," which is incorporated herein by reference, teaches a method for controlling an electrophotographic printing system to print digital image data for an image region. An image region database stores data characterizing a plurality of reference image regions, each reference image region having one or more associated system control parameters that are appropriate for use in printing the reference image region. The system control parameters can include parameters related to correcting color registration errors. The image region to be printed is compared with the reference image regions in the image region database, and a similar reference image region is selected. The image region is printed using the system control parameters associated with the selected similar reference image region.

Commonly assigned, co-pending U.S. patent application Ser. No. 14/447,686, (Sreekumar et al.), filed Jul. 31, 2014, entitled "Controlling a web-fed printer using an image region database," which is incorporated herein by reference, teaches a method for controlling a digital printing system to print digital image data for an image region onto a continuous web of print media. An image region database stores data characterizing a plurality of reference image regions, each reference image region having one or more associated system control parameters that are appropriate for use in printing the reference image region. The system control parameters can include parameters related to correcting color registration errors. The image region to be printed is compared with the reference image regions in the image region database, and a similar reference image region is selected. The image region is printed using the system control parameters associated with the selected similar reference image region.

The aforementioned commonly-assigned U.S. Pat. No. 9,010,900, discloses a method for performing color-to-color correction while printing multiple copies of a document having one or more pages. (It should be noted that U.S. Pat. No. 9,010,900 used different terminology than the present application. A "page" in the present application corresponds to a "document" in U.S. Pat. No. 9,010,900, and a "document" in the present application corresponds to a "print job" in U.S. Pat. No. 9,010,900.) The method of U.S. Pat. No. 9,010,900 involves printing one or more copies of the document and characterizing the color registration errors for each page in the document. At least one image plane correction value is then determined for each page in the document. Subsequent copies of the document are then printed using the image plane correction values, where the image plane correction values used for each page are the correction values determined for that page within the document. The image plane correction values can be updated periodically, at select times, or after each subsequent copy of the document is printed to refine the image plane correction values associated with each page.

The method of U.S. Pat. No. 9,010,900 assumes that each document in a print job has the same number of pages, and that the pages in each document have substantially the same ink coverage as the corresponding pages (in the same sequential location) in each of the other documents. While this method is useful for many types of print jobs, such as the printing of books, catalogues, and magazines, it is not applicable to print jobs in which the page count (i.e., the number of pages in the document) varies from document to document. The present invention overcomes this limitation by recognizing that for many other print jobs, such as the printing of transactional documents, the general document layout is the same for each document even though the page count may vary.

Figure 9:
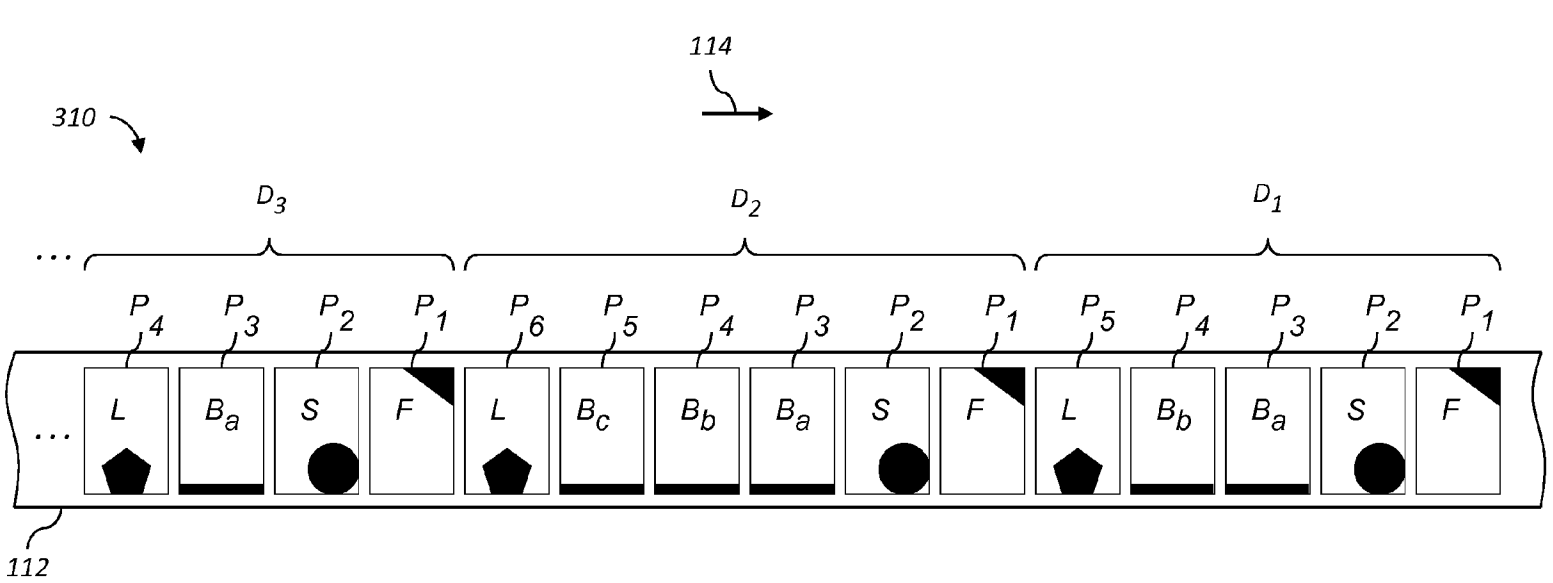
FIG. 9 illustrates a print job including a set of documents.

FIG. 9 shows a portion of a print job 310 that includes multiple documents ($D_1$, $D_2$, $D_3$ . . . ), each document including a plurality of document pages ($P_1$, $P_2$, $P_3$ . . . ). Each of the document pages may include some text (represented by the page type labels: F, S, Ba-Bc, L), and some graphical content such as graphs, logos, pictures, or colored backgrounds (represented by the filled in geometric shapes). In general, text tends to have fairly low ink coverage levels, and therefore tends to contribute only minimally to moisture induced expansion and weakening of the print medium 112. Pictorial or graphical content on the other hand tends to have fairly high ink content and can contribute significantly to the distortion of the print medium 112 due to the moisture induced expansion and weakening of the print medium 112. The illustrated documents $D_1$, $D_2$, $D_3$ each have a similar layout with a first page (labeled F), a second page (labeled S), a last page labeled (L), and one or more body pages (labeled $B_a$, $B_b$, $B_c$). Document $D_1$ has two body pages $B_a$, $B_b$; Document $D_2$ has three body pages, $B_a$, $B_b$, $B_c$ and document $D_3$ has one body page, $B_a$. The first page F of each of the documents $D_1$, $D_2$, $D_3$ all have substantially the same layout and ink coverage levels as each other; the second page S of each of the documents $D_1$, $D_2$, $D_3$ have substantially the same layout and ink coverage levels as each other; the body pages $B_a$, $B_b$, $B_c$ of each of the documents $D_1$, $D_2$, $D_3$ have substantially the same layout and ink coverage levels as each of the other body pages, and the closing page $P_4$ of each of the documents $D_1$, $D_2$, $D_3$ have substantially the same layout and ink coverage levels as each other. However, each page type (first page F, second page S, document body pages $B_a$, $B_b$, $B_c$, and last page L) has a significantly different layout and ink coverage level than each of the other page types. Examples of documents which typically would have this type of layout would include statements from a financial institution, bills from a service provider, or bulk mailing documents having variable image content.

As the different documents $D_1$, $D_2$, $D_3$ do not have the same page count, the corresponding page number of each document generally will not have the same uncorrected registration errors, and therefore cannot be corrected by applying the same associated page number registration corrections. However, inventors have observed that within a print job having a particular document classification type, corresponding pages of documents having the same page count will typically have approximately the same uncorrected registration errors. The present invention takes advantage of this characteristics by classifying each document of a print job by its page count, and then applying registration corrections that are appropriate for the page count. In an exemplary embodiment, the classification of the documents by their page count is carried out by the digital front end controller.

Figure 10:
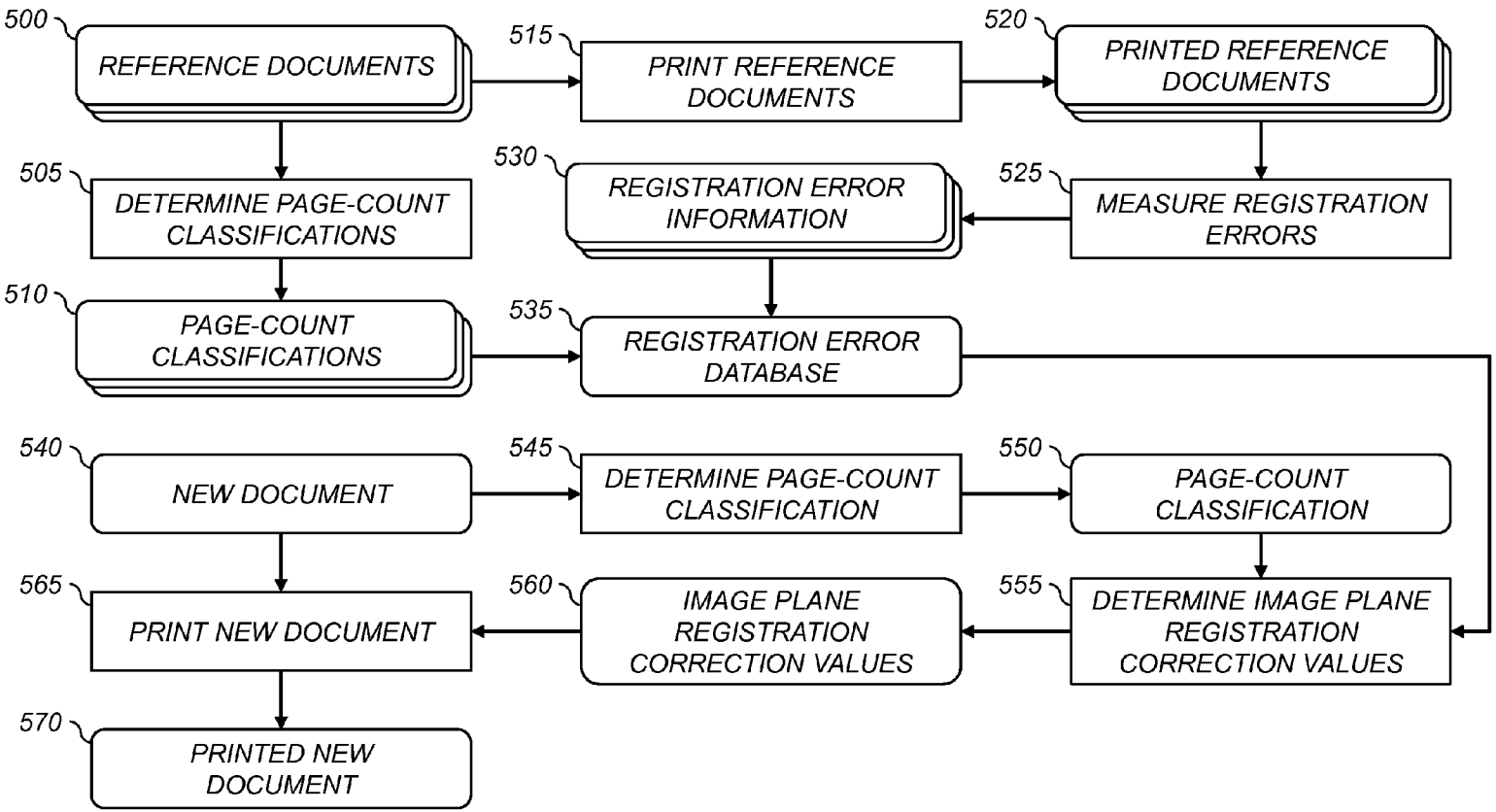
FIG. 10 illustrates a flowchart of a method for correcting registration errors in accordance with the present invention.

FIG. 10 illustrates a flowchart of a method for correcting registration errors in accordance with the present invention. The method involves characterizing the registration errors associated with each document page of a set of reference documents 500 of a particular document-type classification having different numbers of document pages. The characterized registration errors of each page are then used to determine appropriate image plane registration correction values 560 for each page for subsequently printed documents of the same document-type classification and page-count classification.

In some embodiments, the reference documents 500 are the first documents encountered within a print job having a particular number of pages. For example, if a print job includes a series of bank statement documents for different customer including some having 4 pages, some having 5 pages, and some having 6 pages, the first bank statement document in the print job having 4 pages can be used as a reference document 500. Likewise, the first bank statement document having 5 pages and the first bank statement document having 6 pages can also be used as reference documents 500. In an alternate embodiment the reference documents 500 can be a set of training documents in a training print job, where the training documents are representative of the different documents that will be encountered in a typical print job. In particular, the reference documents 500 should include at least one document having each of the different page counts that are likely to be encountered in a print job. In some embodiments of the invention, at the start of a print job, a controller determines which page counts are present within the print job. The controller then forms a training print job including exemplary documents of each page count represented within the print job. In some cases, the reference documents 500 can include a multiple documents having the same page count in order to provide a better estimate of the average registration errors that would be encountered for a particular page count.

Page-count classifications 510 for each of the reference documents 500 are determined using a determine page-count classifications step 505. In an exemplary embodiment, the page-count classification 510 is an integer value representing the number of pages in a particular reference document 500, and the determine page-count classifications step 505 simply counts the number of document pages in each of the reference documents 500 to determine the corresponding page-count classifications 510. In alternate embodiments, the page-count classifications 510 can be a more complex classification providing additional information about the pages in the reference documents 500. For example, the page-count classifications 510 can specify a page type (e.g., first page, second page, body page, last page) for each page. The page type could be determined using a priori knowledge, or by analyzing the image data for each document page.

Next, a print reference documents step 515 is used to print the reference documents 500 on the printing system 100 (FIG. 1) to provide a corresponding set of printed reference documents 520. A measure registration errors step 525 is then used to characterize the registration errors and provide registration error information 530 for each of the reference documents 500. In some cases, an image quality sensor 110 in the printing system 100 can be used to measure the registration errors. In other cases, the printed reference documents 520 can be analyzed using an off-line system. In an exemplary embodiment, one of the image planes (e.g., black) is used as a reference image plane, and registration errors are measured for each of the other planes relative to the reference image plane. In other cases, the registration errors for each image plane can be measured relative to the positions of reference marks (e.g., "cue marks") formed at predefined locations on the print medium 112. Generally, the printed reference documents 520 can be discarded after the registration errors have been measured because the uncorrected registration errors can result in a sub-standard image quality level.

Figure 11:
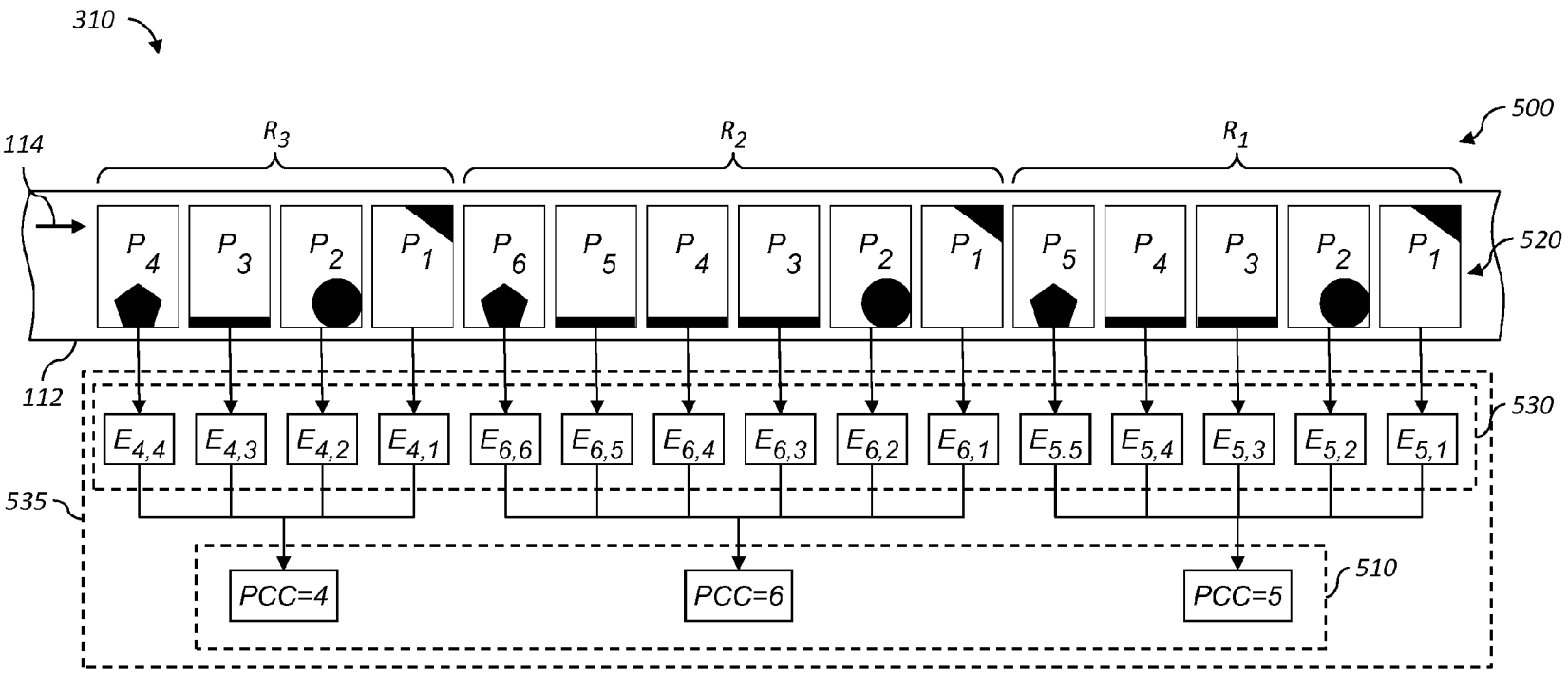
FIG. 11 illustrates the formation of a registration error database based on a set of reference documents.

FIG. 11 shows an example of a print job 310 that includes three reference documents 500 ($R_1$ having 5 document pages, $R_2$ having 6 document pages and $R_3$ having 4 document pages), which are printed on print medium 112 to provide printed reference documents 520. The resulting registration errors are measured for each page of each of the printed reference documents 520 to determine corresponding registration error information 530 (represented by $E_{m,n}$ where m is the page-count classification 510 and n is the page number).

The registration error information 530 is stored in a digital memory in a registration error database 535, in association with the corresponding page-count classifications 510. The digital memory can be one or more processor-accessible memories configured to store digital information. The phrase "processor-accessible memory" is intended to include any processor-accessible data storage device, whether volatile or nonvolatile, electronic, magnetic, optical, or otherwise, including but not limited to, registers, floppy disks, hard disks, Compact Discs, DVDs, flash memories, ROMs, and RAMs.

The registration error information 530 can be stored in a variety of different forms. In some cases, the registration error information 530 can be a representation of the registration errors determined for the printed reference documents 520. For example, the registration errors for each image plane can be represented by a set of registration error parameters corresponding to amounts of a set of different types of registration errors (e.g., cross-track translation error, in-track translation error, cross-track magnification error, in-track magnification error, rotation error). The registration error parameters can be stored using any convenient units such as pixels, absolute physical quantities (e.g., millimeters, degrees), or relative physical quantities (e.g., percent magnification). In other cases, the registration error information 530 can be a representation of the amount of correction that would be required to correct for the registration errors determined for the printed reference documents 520.

In some embodiments, the reference documents 500 will include only a single document for each of the different page-count classifications 510. In this case, the registration error information 530 stored in the registration error database 535 for each page-count classification 510 will be determined based on measurements of a single printed reference document 520. In other embodiments, a plurality of reference documents 500 can be used for some or all of the page-count classifications 510. In this case, the measured registration errors for the set of reference documents 500 having a given page-count classification 510 can be combined to determine the registration error information 530 stored in the registration error database 535. Various forms of statistical analysis to combine the measured registration errors, including averaging, and elimination of outliers to reduce the noise in the registration error measurements in the determination of the registration error information 530 so that better registration correction values can be determined.

Table I shows an example of a registration error database 535 for a particular document-type classification (e.g., bank statements for a particular bank). There are three different page-count classifications 510 corresponding to 4-page documents, 5-page documents, and 6-page documents. For each page-count classification 510, the registration error database 535 stores a set of registration errors for each image plane for each document page, and each page number. In this example, the registration errors include a cross-track translation error ($T_c$) and an in-track translation error ($T_i$) measured in pixels, as well as a cross-track magnification error ($M_c$) and an in-track magnification error ($M_i$) measured in measured in percent change in magnification. The registration errors in this example, are determined relative to a black image plane, which was used as the reference image plane.

TABLE I

Example Registration Error Database

| Page-Count Classification | Page Number | Image Plane | Registration Error Values $T_c$ | $T_i$ | $M_c$ | $M_i$ |
|---|---|---|---|---|---|---|
| 4 | 1 | C | 0 | 1 | 0.12 | 0.20 |
| | | M | 2 | −3 | −0.02 | −0.04 |
| | | Y | −1 | 1 | 0.01 | 0.02 |
| | 2 | C | 2 | 0 | 0.08 | 0.12 |
| | | M | 4 | 1 | 0.06 | 0.09 |
| | | Y | −1 | −1 | 0.08 | 0.10 |
| | 3 | C | 1 | 0 | 0.08 | 0.13 |
| | | M | 3 | −1 | 0.06 | 0.08 |
| | | Y | −1 | 2 | 0.09 | 0.10 |
| | 4 | C | 2 | 1 | 0.10 | 0.12 |
| | | M | 4 | 3 | 0.13 | 0.16 |
| | | Y | −2 | −1 | 0.05 | 0.09 |
| 5 | 1 | C | 0 | 1 | 0.12 | 0.20 |
| | | M | 2 | −3 | −0.02 | −0.04 |
| | | Y | −1 | 1 | 0.01 | 0.02 |
| | 2 | C | −2 | 0 | 0.08 | 0.12 |
| | | M | 4 | 1 | 0.06 | 0.09 |
| | | Y | −1 | −1 | 0.08 | 0.10 |
| | 3 | C | 1 | 0 | 0.08 | 0.13 |
| | | M | 3 | −1 | 0.06 | 0.08 |
| | | Y | −1 | 2 | 0.09 | 0.10 |
| | 4 | C | 1 | 0 | 0.08 | 0.13 |
| | | M | 3 | −1 | 0.06 | 0.08 |
| | | Y | −1 | 2 | 0.09 | 0.10 |
| | 5 | C | 2 | 1 | 0.10 | 0.12 |
| | | M | 4 | 3 | 0.13 | 0.16 |
| | | Y | −2 | −1 | 0.05 | 0.09 |
| 6 | 1 | C | 0 | 1 | 0.12 | 0.20 |
| | | M | 2 | −3 | −0.02 | −0.04 |
| | | Y | −1 | 1 | 0.01 | 0.02 |
| | 2 | C | 2 | 0 | 0.08 | 0.12 |
| | | M | 4 | 1 | 0.06 | 0.09 |
| | | Y | −1 | −1 | 0.08 | 0.10 |
| | 3 | C | 1 | 0 | 0.08 | 0.13 |
| | | M | 3 | −1 | 0.06 | 0.08 |
| | | Y | −1 | 2 | 0.09 | 0.10 |
| | 4 | C | 1 | 0 | 0.08 | 0.13 |
| | | M | 3 | −1 | 0.06 | 0.08 |
| | | Y | −1 | 2 | 0.09 | 0.10 |
| | 5 | C | 1 | 0 | 0.08 | 0.13 |
| | | M | 3 | −1 | 0.06 | 0.08 |
| | | Y | −1 | 2 | 0.09 | 0.10 |
| | 6 | C | 2 | 1 | 0.10 | 0.12 |
| | | M | 4 | 3 | 0.13 | 0.16 |
| | | Y | −2 | −1 | 0.05 | 0.09 |

Once the registration error information 530 has been determined and stored in the registration error database 535, it can be used to improve the registration for subsequently printed documents having the same document-type classification and one of the page-count classifications 510 in the registration error database 535.

In some embodiments, the printing system 100 (FIG. 1) may be adapted to print a plurality of different types of documents. In this case, registration error databases 535 can be determined for each of the different document-type classifications. For example, different registration error databases 535 can be provided for statements from various financial institutions, for bills from various service providers, and for bulk mailing documents from various advertisers.

Returning to a discussion of FIG. 10, to print a new document 540, a determine page-count classification 545 is used to determine a corresponding page-count classification 550 corresponding to the number of document pages in the new document 540. In this example, the new document 540 has the same document-type classification as the reference documents 500 that were used to determine the registration error database 535. For cases where the printing system 100 (FIG. 1) is used to print a variety of different document types, a registration error database 535 should be selected for use corresponding to the document-type classification of the new document 540.

A determine image plane registration correction values step 555 is used to determine an appropriate set of image plane registration correction values 560 that can be used to print the new document 540 based on the registration error information 530 stored in the registration error database 535. In an exemplary embodiment, the determine image plane registration correction values step 555 extracts the set of registration errors corresponding to the page-count classification 550 from the registration error database 535 and provides a set of image plane registration correction values 560 that will compensate for the registration errors. For example, if the new document 540 is a 5 page document of the document-type classification corresponding to the example registration error database 535 of Table I, then when printing the cyan image plane for page 2 of the document, the associated registration errors ($T_c$=−2 pixels, $T_i$=0 pixels, $M_c$=0.08%, $M_i$=0.12%) can be retrieved from the registration error database 535. Corresponding image plane registration correction values 560 can be determined that are appropriate to correct for these registration errors. In this example, the cross-track translation error ($T_c$) is −2 pixels, so that a corresponding image plane registration correction value 560 would specify that the image plane should be translated by +2 pixels to compensate for this registration error. Analogous corrections for the other registration error components can be determined in a similar manner.

As mentioned earlier, in some embodiments, the registration error information 530 stored in the registration error database 535 can be a representation of the image plane registration corrections that would be required to correct the registration errors. In this case, the image plane registration correction values 560 can be extracted directly from the registration error database 535 without the need to perform additional calculations. This has the advantage that it saves the need to repeatedly perform the calculations needed to determine the image plane registration correction values 560 for each new document 540.

A print new document step 565 is then used to print the image data for each document page of the new document 540 responsive to the determined image plane registration correction values 560 to provide printed new document 570. In some embodiments, the image plane registration correction values are used to modify the image data associated with the image planes of the new document 540 to produce modified image data. For example, the image data for an image plane can be modified by translating it, resizing it, rotating it or skewing it in accordance with the image plane registration correction values 560. The modified image data can then be printed normally using the printing system 100 (FIG. 1). In other embodiments, some or all of the image plane corrections can be applied by adjusting the image data as it is being printed, or by adjusting the printing process. The printed new document 570 will have an improved level of image plane registration, and therefore an improved level of image quality, relative to the case where no image plane registration corrections are applied.

Figure 12:
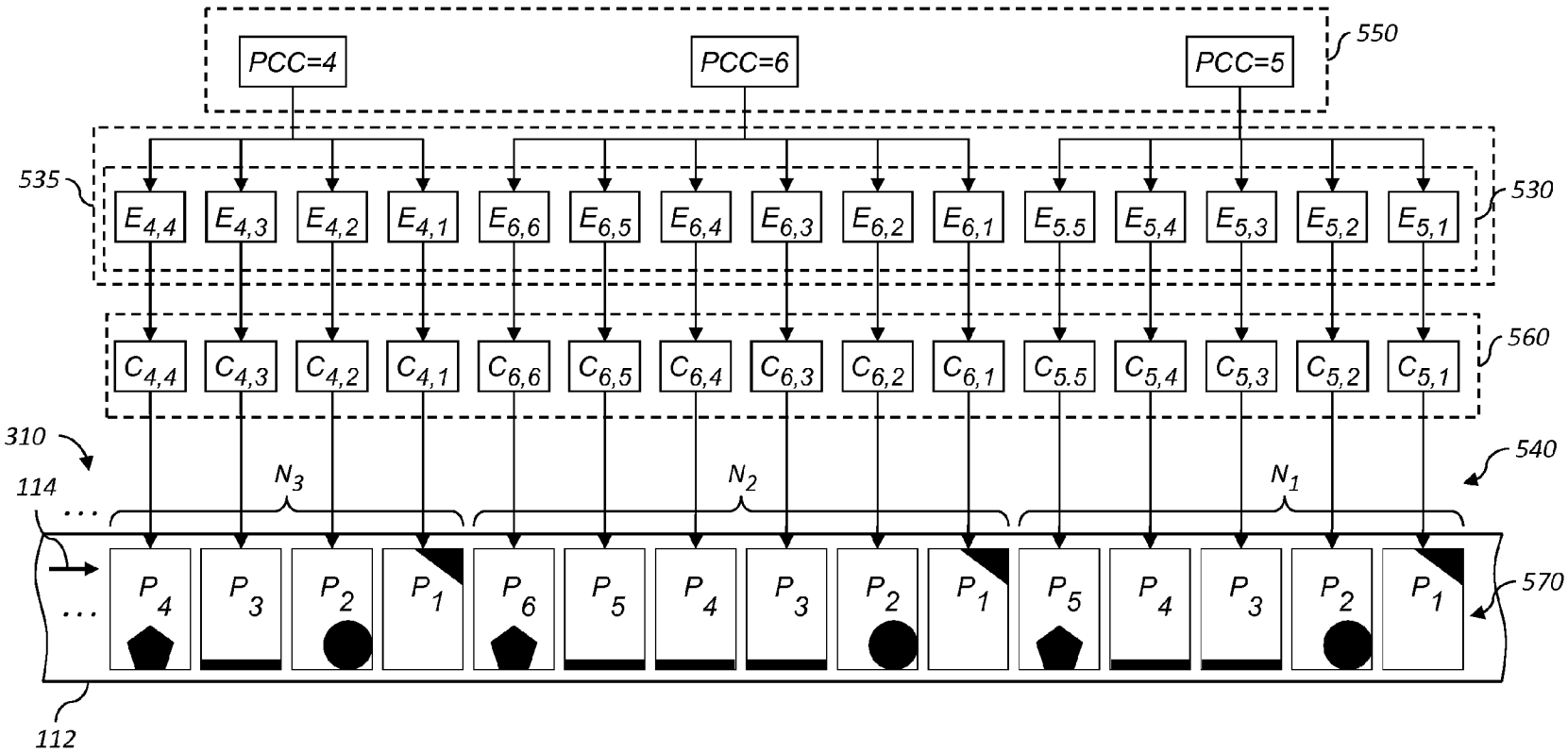
FIG. 12 illustrates the correction of registration errors for a set of documents using registration error information stored in a registration error database.

FIG. 12 shows an example of a print job 310 including three new documents 540 ($N_1$ having 5 document pages, $N_2$ having 6 document pages and $N_3$ having 4 document pages). The corresponding page-count classifications 550 (PCC) are determined and used to extract the corresponding registration error information 530 from the registration error database 535. A set of corresponding image plane registration correction values 560 is determined (represented by $C_{m,n}$ where m is the page-count classification 510 and n is the page number). The image plane registration correction values 560 are then used to print the set of new documents 540 to provide the printed new documents 570.

In some embodiments, the image plane registration correction values 560 can be used to control a web-transport system that moves the web of print medium 112 through the printing system 100. For example, the web-transport system can be controlled to steer the print medium 112, or adjust the speed that the print medium 112 moves through the printing system 100. For example, the print medium 112 can be steered using the media transport system described in commonly-assigned U.S. Patent Application Publication 2013/0113857 (Armbruster et al.), entitled "Media transport system including active media steering," which is incorporated herein by reference. This approach uses structures such as steered caster rollers to steer the web of media. In other embodiments, the print medium 112 can be steered using the media transport system described in commonly-assigned U.S. Pat. No. 9,120,634 (Muir et al.), entitled "Media guiding system using Bernoulli force roller," which is incorporated herein by reference. This approach uses one or more media-guiding rollers having grooves formed around the exterior surface. An air source is controlled to provide an air flow into the grooves, thereby producing a Bernoulli force to draw the web of media into contact with the media-guiding rollers. An axis of the media-guiding rollers can be positioned to steer the web of media, or to perform other functions such providing a stretching force in the cross-track direction to prevent the formation of wrinkles.

In some embodiments, in-track image plane shifts can be applied by adjusting the timing at which lines of image data are printed using the printheads 200 (FIG. 2). For example, to shift the image forward along the print medium 112, the lines of image data can be printed at a slightly earlier time than they would be nominally, and to shift the image backward along the print medium 112, the lines of image data can be printed at a slightly later time than they would be nominally.

In some embodiments, cross-track image plane shifts can be applied by adjusting which inkjet nozzles are used to print the image data. For example, the image data supplied to the printheads can be shifted left or right to use different subsets of the nozzles in the printheads 200. In other embodiments, a servo-system can be used to adjust a cross-track position of the print medium 112 to apply the cross-track image plane shifts.

In some embodiments, cross-track magnification changes can be applied out using the methods described in commonly assigned U.S. Pat. No. 8,760,712 (Enge et al.) entitled: "Modifying image data using matching pixel patterns", and commonly assigned, U.S. Pat. No. 8,845,059 (Enge et al.), entitled: "Aligning print data using matching pixel patterns", each of which is incorporated herein by reference. This method involves inserting or deleting image pixels across the width of the printhead 200 to adjust the size of the printed image in the cross-track direction 406.

In some embodiments, in-track magnification changes can be applied by adjusting the timing at which lines of image data are printed by the printheads 200. For example, to increase the in-track image size, the timing between the printing of successive lines of image data can be increased slightly, and to decrease the in-track image size, the timing between the printing of successive lines of image data can be decreased slightly.

Figure 13:
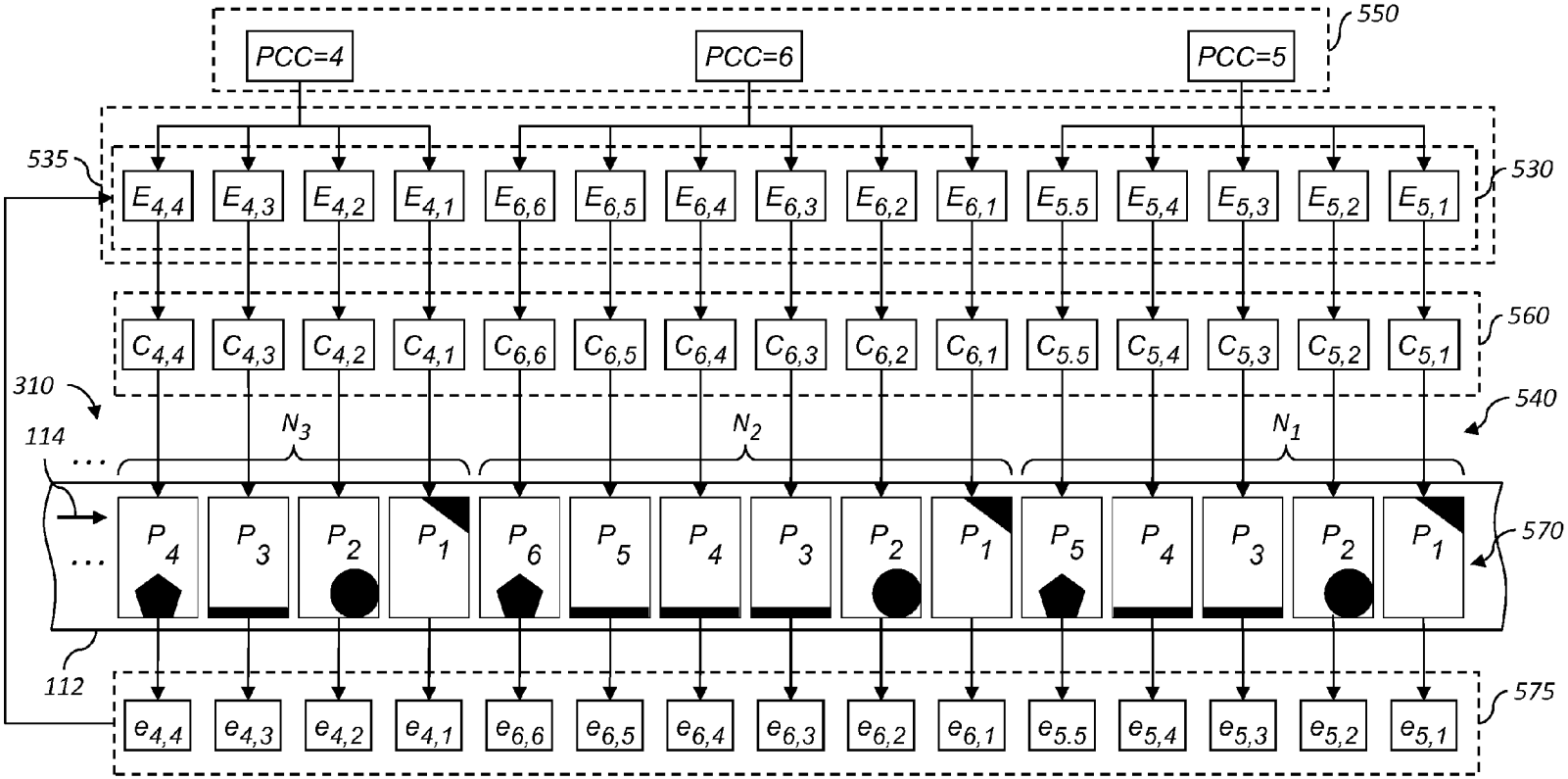
FIG. 13 illustrates refining the registration error information in the registration error database based on residual registration errors measured for printed documents.

As illustrated in FIG. 13, in some embodiments, after a new document 540 has been printed using the image plane registration correction values 560 determined from the registration error database 535, residual registration errors 575 can be measured for each page of the printed new document 570. The measured residual registration errors 575 can then be used to refine the registration error information 530 stored in the registration error database 535. The refined registration error information 530 can then be used to print subsequent documents. In this way, the average registration errors can be reduced over time as more documents are printed.

The refined registration error values can be determined in various manners. In a simple approach, it can be assumed that all of the residual registration errors are systematic errors that should be fully compensated for in subsequent documents. In this case, the residual registration errors can simply be added to the registration errors stored in the registration error database 535 to determine the refined registration errors:

$$E'_{m,n}=E_{m,n}+e_{m,n}. \quad (1)$$

However, there will typically be a random component to the registration errors. Therefore, it can be advantageous to adjust the stored registration error information more gradually. One way to do this is to add only a portion of the residual error to the previous registration error value:

$$E'_{m,n}=E_{m,n}+k(e_{m,n}). \quad (2)$$

where k is a weighting factor between 0 and 1. This has the effect of performing a weighted average between the original registration error estimate and the registration error indicated by the residual registration error of the current document. It can also be advantageous to apply a statistical outlier test so that the registration error information 530 is not updated, or is updated using a smaller weighting factor, for cases where the registration errors for the new document 540 are significantly different than the previously measured registration errors.

In some cases, a new document 540 may be encountered having a page-count classification 550 that is different from any of the page-count classifications 510 stored in the registration error database 535. For example, if the most common financial statements from a particular financial institution are either 4, 5 or 6 pages long, the reference documents 500 used to build the registration error database 535 may only include financial statements having those page-count classifications. However, an unusually long financial statement having more than 6 pages or an unusually short financial statement having less than 4 pages may occasionally be printed. Such documents can be referred to as "exception documents." As discussed earlier, in some embodiments rather than printing a set of reference documents 500 ahead of time to provide the registration error database 535, the first document of each page-count classification 550 is used as a reference document 500. In this case, the first document of a given page-count classification 550 in a print job will be an exception document.

Figure 14:
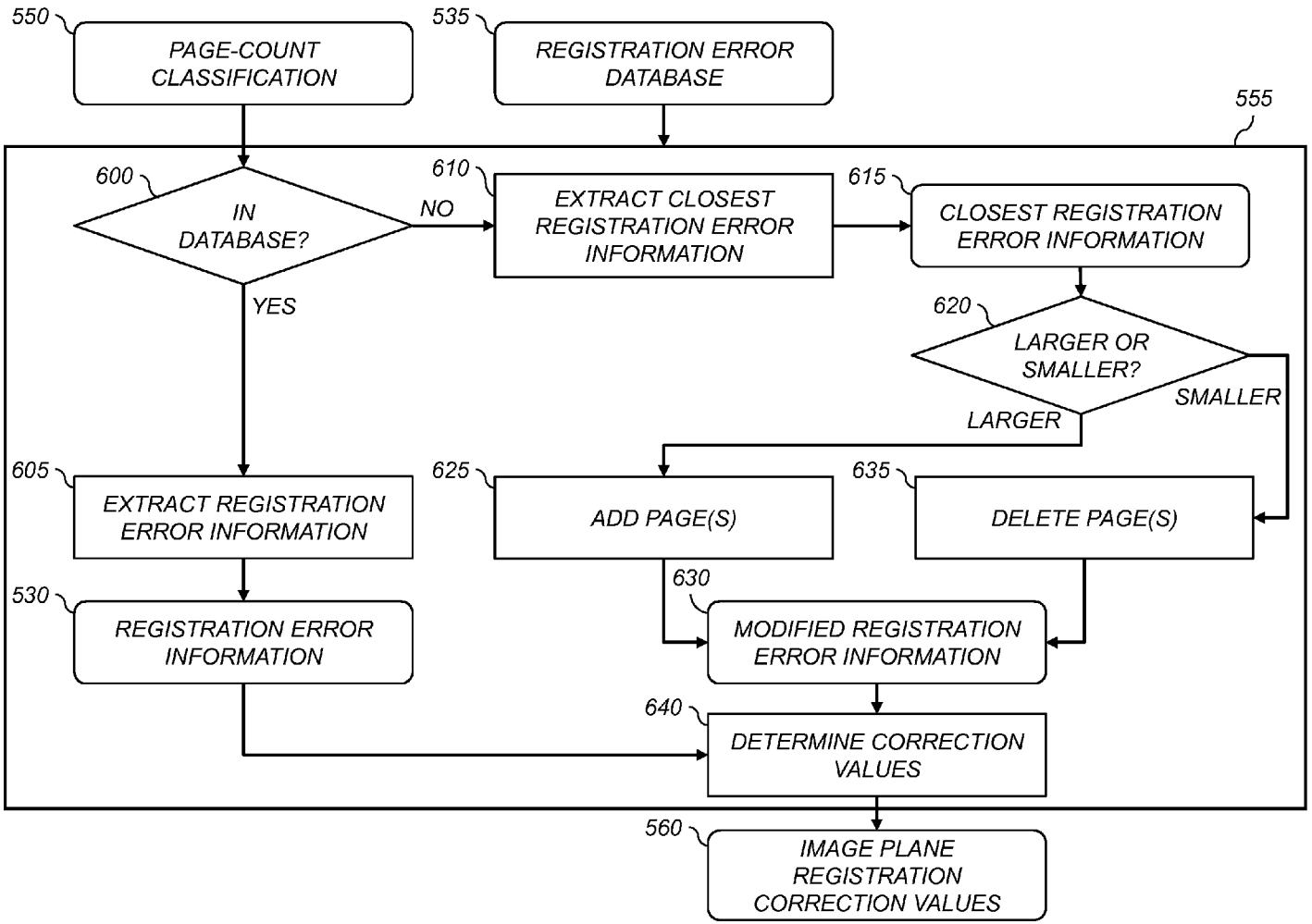
FIG. 14 illustrates a flowchart of a method for determining image plane registration correction values for exception documents having page count classifications that are not in the registration error database.

The registration error database 535 will not have information that can be used directly to compensate for the registration errors that would be associated with exception documents. Therefore, it is necessary to form a strategy for printing such documents. In an exemplary embodiment, image plane registration correction values 560 for each page of the exception document are determined from the stored registration error information 530 in the registration error database 535 associated with a different page-count classification 510. One approach that can be used to handle exception documents is illustrated in FIG. 14, which illustrates additional details of the determine image plane registration correction values step 555 of FIG. 10.

An in-database test 600 is used to compare the page-count classification 550 of the new document 540 (FIG. 10) to the page-count classifications 510 (FIG. 10) stored in the registration error database 535. If the page-count classification 550 is in the registration error database 535, then an extract registration error information step 605 is used to extract the registration error information 530 associated with the page-count classification 550. Otherwise, if the page-count classification 550 is not in the registration error database 535, then an extract registration error information step 605 is used to extract closest registration error information 610 associated with the closest page-count classification in the registration error database 535. In some embodiments, rather than extracting the registration error information associated with the closest page-count classification, the registration error information can be extracted for the most commonly encountered (i.e., "dominant") page-count classification 510. For example, if the most common document is known to have 5 document pages, then the registration error information corresponding to this page-count classification can be used for the closest registration error information 615.

A larger-or-smaller test 620 directs the flow depending on whether the page-count classification 550 of the new document 540 is smaller or larger than the page count associated with the closest registration error information 615. If the page-count classification 550 is larger than the page count associated with the closest registration error information 615, then an add page(s) step 625 is used to add registration error information for one or more additional pages to the closest registration error information 615 extracted from the registration error database 535 to provide modified registration error information 630 having the correct page count. If the page-count classification 550 is smaller than the page count associated with the closest registration error information 615, then a delete page(s) step 635 is used to delete registration error information for one or more pages from the closest registration error information 615 extracted from the registration error database 535 to provide modified registration error information 630 having the correct page count. A determine correction values step 640 is then used to determine the image plane registration correction values 560 using either the registration error information 530 or the modified registration error information 630 modified registration error information 630.

The add page(s) step 625 can add the registration error information for the additional pages in a variety of different ways. In some cases, the registration error information associated with one of the pages in the closest registration error information 615 can be duplicated to provide the additional pages. For example, if it is known that the documents in the document-type class typically include a variable number of body pages ($B_a$, $B_b$, $B_c$), the registration error information for the final body page in the closest registration error information 615 can be duplicated one or more times to insert additional pages before the last page (L). In other cases, the additional pages can be added based on combining the registration error information for one or more of the existing pages. For example, the registration error information for all of the body pages can be averaged to provide the registration error information for the additional pages. In cases where the documents in the document-type class don't have a known structure, registration error information for additional pages can be provided by means such as duplicating the registration error information for the last page, or averaging the registration error information for the some or all of the other pages.

The delete page(s) step 635 can delete the registration error information for one or more pages in a variety of different ways. For example, if it is known that the documents in the document-type class typically include a variable number of body pages ($B_a$, $B_b$, $B_c$), the registration error information for one or more of the body pages in the closest registration error information 615 can be deleted. In cases where the documents in the document-type class don't have a known structure, registration error information for one or more arbitrarily selected pages (e.g., the highest page number pages) can be deleted.

In an alternate approach, the image content in each of the pages of the exception document can be compared to the image content for each of the pages of the reference document 500 (FIG. 10) corresponding to the closest registration error information 615. The registration error information for the pages of the reference document 500 having the most similar image content can be used for the pages of the exception document. Algorithms for determining image similarity are well known in the image processing art.

After a set of image plane registration correction values 560 have been determined for the exception document, it can be printed using the printing system 100, and the resulting residual registration errors can be measured. As described earlier, the residual registration errors can be used to refine the registration errors that were used to print the document. A new entry can then be added to the registration error database 535 corresponding to the page-count classification 550 of the exception document based on the refined registration error estimate for each of the document pages. Then, when subsequent documents are printed having this page-count classification 550, the registration error database 535 will include appropriate registration error information 530 that can be used to provide appropriate registration correction.

The registration errors for a document being printed can be affected to some degree by the documents printed before or after the current document. In some embodiments, the image plane registration correction values 560 applied to the document pages of the new document 540 can be determined not only as a function of the page-count classification 550 of the new document 540 being printed, but also on the page-count classifications of one or more adjacent documents. The one or more adjacent documents can include documents printed immediately before the new document 540 (i.e., downstream documents) and/or documents printed immediately after the new document 540 (i.e., upstream documents). This enables the image plane registration correction values 560 to be refined to more effectively reduce the registration errors.

In an exemplary embodiment, the page-count classifications of the one or more upstream and downstream documents serve as sub classifications to the page-count classification 550 of the new document 540. This sub-classification of the new document 540 based on the page-count classifications of one or more upstream and downstream documents can be referred to as a "history sub-classification." With this approach, the registration error database 535 can store different registration error information 530 for a set of different sub-classifications for each of the page-count classifications. For example, one set of registration error information 530 can be stored for use with a new document 540 having a page-count classification 550 of 6-pages with a history sub-classification indicating that the previous document was a 4-page document, and another set of registration error information 530 can be stored for use with a new document 540 having a page-count classification 550 of 6-pages with a history sub-classification indicating that the previous document was a 5-page document. If registration error information 530 for the particular history sub-classification has not previously been stored in the registration error database 535, then a generic set of registration error information 530 corresponding to the page-count classification 550 can be used that has no history sub-classification. As documents are printed having different history sub-classifications, the registration errors can be measured and additional registration error information 530 can be added to the registration error database 535 pertaining to the additional history sub-classifications. In this way, registration errors can be reduced for subsequently printed documents having those history sub-classifications.

Figure 15:
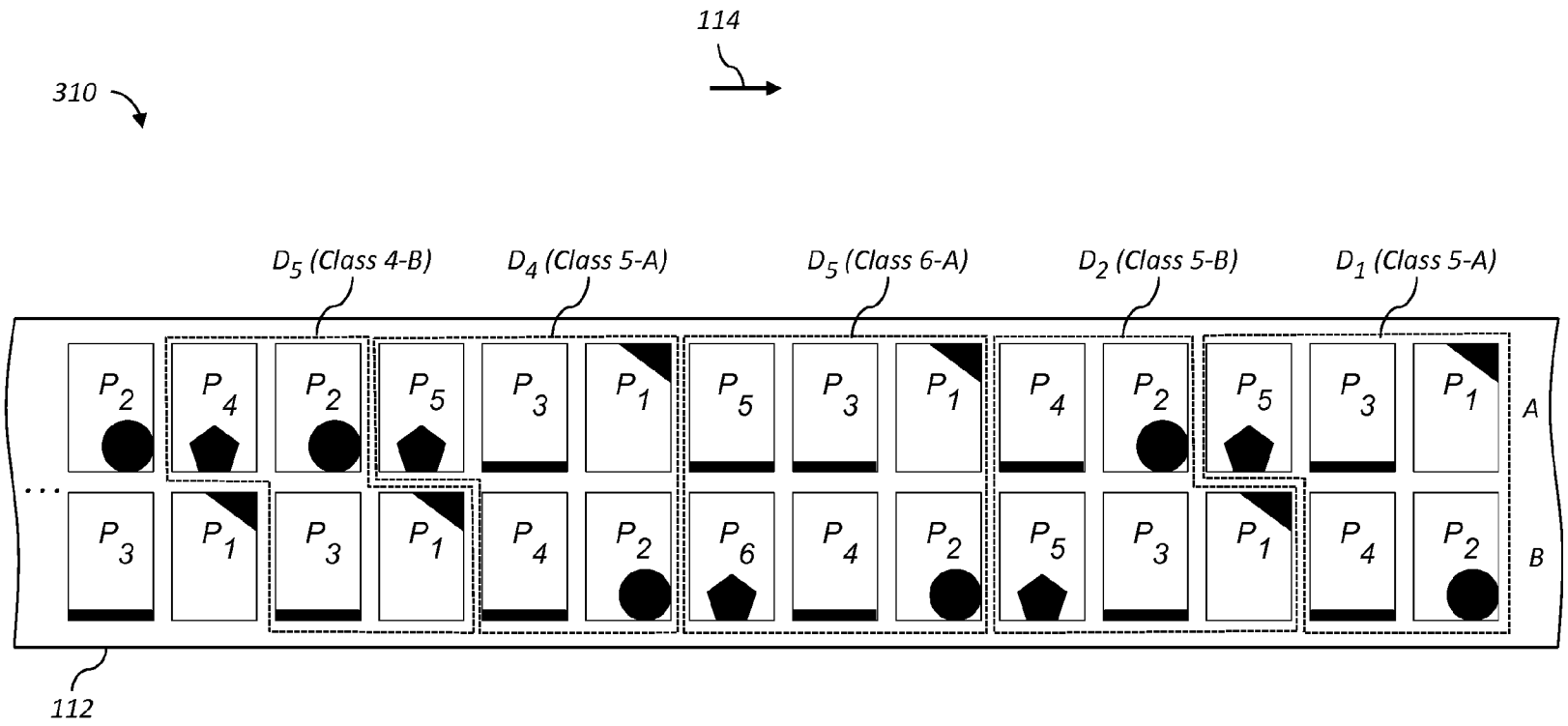
FIG. 15 illustrates a print job including a set of documents that are printed in a 2-up configuration on the web of print medium.

In some printing systems 100, the print medium 112 has sufficient width to allow multiple documents to be printed concurrently in side-by-side print lanes. Such a configuration is sometimes referred to as a "multi-up configuration." FIG. 15 illustrates a 2-up configuration having two side-by-side print lanes, denoted as an A lane and a B lane. In an exemplary arrangement, consecutive pages of a document are stepped first side-to-side across the web of print medium 112, and then down the web as shown. This page arrangement is known as "step and continue page imposition." In this example, the first document $D_1$ in print job 310 has 5 pages ($P_1$, $P_2$, $P_3$, $P_4$, $P_5$) where the first page $P_1$ starts in print lane A. Similarly, the second document $D_2$ has 5 pages where the first page $P_1$ starts in print lane B; the third document $D_3$ has 6 pages where the first page $P_1$ starts in print lane A; the fourth document $D_4$ has 5 pages where the first page $P_1$ starts in print lane 1; and the fifth document $D_5$ has 4 pages where the first page $P_1$ starts in print lane B.

In a multi-up configuration, the registration errors for a particular document page depend not only on the other pages in the same print lane but also on the pages printed in the other print lane. Therefore the uncorrected registration errors of document $D_1$, which has its first page in print lane A, are generally different from the registration errors of document $D_2$, which has its first page in print lane B, even though they have the same page count. Recognizing this, some embodiments of the invention for use in multi-up print configurations can classify documents not only by their page-count classification, but also by a "print-lane sub-classification." In an exemplary embodiment, the print-lane sub-classification is the print lane where the first document page of the document is printed. Accordingly, document $D_1$ would be classified as 5-A (a page-count classification of 5, with a print-lane sub-classification of A), document $D_2$ would be classified as 5-B, document $D_3$ would be classified as 6-A, document $D_4$ would be classified as 5-A, and document $D_5$ would be classified as 4-B. While the illustrated example shows 2 print lanes, it will be obvious to one skilled in the art that this classification system can easily be extended to any number of print lanes. A similar strategy can be used in multi-up print configurations for the case where all of the pages of a given document are printed in the same print lane. In that case, the print-lane sub-classification would indicate the print lane where all of the pages will be printed.

With this approach, the registration error database 535 can store different registration error information 530 for a set of different print-lane sub-classification for each of the page-count classifications. For example, one set of registration error information 530 can be stored for use with a new document 540 having a page-count classification 550 of 5-pages with a print-lane sub-classification indicating that the first page is printed in print lane A, and another set of registration error information 530 can be stored for use with a new document 540 having a page-count classification 550 of 5-pages with a print-lane sub-classification indicating that the first page is printed in print lane B. If registration error information 530 for the particular print-lane sub-classification has not previously been stored in the registration error database 535, then a generic set of registration error information 530 corresponding to the page-count classification 550 can be used that has no print-lane sub-classification. As documents are printed having different print-lane sub-classifications, the registration errors can be measured and additional registration error information 530 can be added to the registration error database 535 pertaining to the additional print-lane sub-classifications. In this way, registration errors can be reduced for subsequently printed documents having those print-lane sub-classification.

In some embodiments, documents may be classified not only by their page count but also content of one or more pages in the document. For example in some "trans-promo" documents (a transactional document with included promotional material) different types of promotional material (e.g., advertisements) may be appended to the document depending on the recipient of the document. The promotional material would typically have relatively high ink coverage levels compared to the pages of the document having the transactional content. The higher ink coverage levels of the promotional material can have a significant affect the image plane registration. As a result, the registration errors for the document pages can depend on whether promotional material is included, and even on which promotional material was included in the document for a given recipient. To address this problem, an image-content sub-classification can be introduced relating to the image content of one or more of the document pages. For example, if it is known that the promotional material is always included on the last document page, the average ink laydown for the last document page can be computed and classified into a set of bins (e.g., low-laydown, medium-laydown and high-laydown) which can be used as the image-content sub-classification. In another example, if there are a finite set of different promotional pages (e.g., no advertisement, advertisement A, advertisement B and advertisement C) that are used for different recipients, then a different image-content sub-classification can be assigned corresponding to each of the different promotional page options.

With this approach, the registration error database 535 can store different registration error information 530 for a set of different image-content sub-classification for each of the page-count classifications. For example, one set of registration error information 530 can be stored for use with a new document 540 having a page-count classification 550 of 5-pages with an image-content sub-classification indicating that advertisement A was included as the last page, and another set of registration error information 530 can be stored for use with a new document 540 having a page-count classification 550 of 5-pages with an image-content sub-classification indicating that advertisement B was included as the last page. If registration error information 530 for the particular image-content sub-classification has not previously been stored in the registration error database 535, then a generic set of registration error information 530 corresponding to the page-count classification 550 can be used that has no image-content sub-classification. As documents are printed with different image-content sub-classifications, the registration errors can be measured and additional registration error information 530 can be added to the registration error database 535 pertaining to additional image-content sub-classifications. In this way, registration errors can be reduced for subsequently printed documents having those image-content sub-classification.

The invention has been described in detail with particular reference to certain preferred embodiments thereof, but it will be understood that variations and modifications can be effected within the spirit and scope of the invention.

PARTS LIST

100 printing system
102 print module
104 print module
106-1 linehead
106-2 linehead
106-3 linehead
106-4 linehead
108 dryer
110 quality control sensor
111 web tension system
112 print medium
114 transport direction
116 turnover module
118 processing system
120 storage system
200 printhead
202 nozzle array
204 support structure
206 heat
300 print job
310 print job
400 reference image plane
402 image plane
404 in-track direction
406 cross-track direction
408 image plane
410 image plane
412 image plane
414 image plane
500 reference documents
505 determine page-count classifications step
510 page-count classifications
515 print reference documents step
520 printed reference documents
525 measure registration errors step
530 registration error information
535 registration error database
540 new document
545 determine page-count classification step
550 page-count classification
555 determine image plane registration correction values step
560 image plane registration correction values
565 print new document step
570 printed new document
575 residual registration errors
600 in-database test
605 extract registration error information step
610 extract closest registration error information step
615 closest registration information
620 larger-or-smaller test

625 add page(s) step
630 modified registration error information
635 delete page(s) step
640 determine correction values step
$B_a$ body page
$B_b$ body page
$B_c$ body page
$C_{m,n}$ registration correction values
$D_1$ document
$D_2$ document
$D_3$ document
$E_{m,n}$ registration error information
F first page
L last page
$N_1$ new document
$N_2$ new document
$N_3$ new document
$P_N$ document page
$P_1$ document page
$P_2$ document page
$P_3$ document page
$P_4$ document page
$P_5$ document page
$P_6$ document page
$R_1$ reference document
$R_2$ reference document
$R_3$ reference document
S second page

The invention claimed is:

1. A method for correcting image plane registration errors for a multi-channel printing system that prints documents by depositing ink onto a print medium that is subject to physical distortions caused by moisture-induced expansion of the print medium, such distortions being dependent on an amount of deposited ink, each document including a set of document pages to be printed on the same side of the print medium, each document page having an associated page number and having associated image data for a plurality of image planes, comprising:

designating an image plane registration error database associated with a particular document-type classification to be used in correcting image plane registration errors, the image plane registration error database storing image plane registration error information characterizing registration errors between image planes as a function of page number for each of a plurality of different page-count classifications, the registration errors being caused by physical distortions of the print medium due to the deposited ink, wherein the page-count classification corresponds to the number of document pages in the document;

receiving a new document of the particular document-type classification;

determining a page-count classification for the new document corresponding to the number of document pages in the new document;

determining image plane registration correction values for each document page of the new document that reduce registration errors between image planes caused by physical distortions of the print medium based on the stored image plane registration error information associated with the determined page-count classification, wherein the image plane registration correction values for each document page of the new document are determined based on the stored image plane registration error information for the corresponding page number; and using the multi-channel printing system to print the image data for each document page of the new document, wherein a spatial alignment of the image planes is adjusted responsive to the corresponding determined image plane registration correction values to compensate for the physical distortions of the print medium due to the deposited ink.

2. The method of claim 1, wherein the image plane registration error database is determined by:

receiving image data for a plurality of reference documents having the particular document-type classification;

determining a page-count classification for each reference document corresponding to the number of document pages in the reference document, wherein at least some of the reference documents have different page-count classifications;

using the multi-channel printing system to print the image data for the set of document pages for each reference document;

measuring registration errors between image planes for each of the document pages of the printed reference documents;

determining image plane registration error information characterizing the registration errors between image planes as a function of page number within a document for a plurality of different page-count classifications; and storing the determined image plane registration error information in the image plane registration error database.

3. The method of claim 2, wherein the reference documents are part of a print job that includes a plurality of documents having the particular document-type classification, and wherein the new document is also part of the print job.

4. The method of claim 3, wherein a first document in the print job having a particular page-count classification is designated to be a reference document.

5. The method of claim 2, wherein the reference documents are in a training print job which is separate from a print job including the new document.

6. The method of claim 1, wherein the image plane registration error information characterizing the registration errors between image planes stored in the image plane registration error database is a representation of the registration errors for each page number within the document.

7. The method of claim 1, wherein the image plane registration error information characterizing registration errors between image planes stored in the image plane registration error database is a representation of registration error correction values appropriate to correct the registration errors for each page number within the document.

8. The method of claim 1, wherein the image plane registration error information include an in-track translation parameter, a cross-track translation parameter, an in-track magnification parameter, a cross-track magnification parameter, or an image rotation parameter.

9. The method of claim 1, wherein the image data for the document pages of the new document is modified responsive to the corresponding determined image plane registration correction values, and wherein the modified image data is printed using the multi-channel printing system.

10. The method of claim 1, wherein one or more components of a web-transport system in the multi-channel printing system are adjusted responsive to the corresponding determined image plane registration correction values.

11. The method of claim 1, wherein a timing at which the image data is printed using the multi-channel printing system is adjusted responsive to the corresponding determined image plane registration correction values.

12. The method of claim 1, further including:

receiving an exception document of the particular document-type classification having a page-count classification that differs from the page-count classifications associated with the stored image plane registration information in the image plane registration error database;

determining image plane registration correction values for each document page of the exception document based on the stored image plane registration error information associated with a different page-count classification; and using the multi-channel printing system to print the image data for each document page of the exception document responsive to the corresponding determined image plane registration correction values.

13. The method of claim 12, wherein the image plane registration correction values for each document page of the exception document are determined by:

identifying a page-count classification included in the image plane registration error database that is closest to the page-count classification of the exception document;

extracting the image plane registration error information associated with the identified page-count classification from the image plane registration error database;

if the identified page-count classification is less than the page-count classification of the exception document, adding image plane registration error information for one or more document pages to the extracted image plane registration error information by copying the image plane registration error information for one of the other document pages or by combining the image plane registration error information for a plurality of the other document pages, thereby providing estimated image plane registration error information for each of the document pages of the exception document;

if the identified page-count classification is larger than the page-count classification of the exception document, removing image plane registration error information for one or more document pages from the extracted image plane registration error information, thereby providing estimated image plane registration error information for each of the document pages of the exception document; and determining image plane registration correction values for each document page of the exception document based on the estimated image plane registration error information determined for the exception document, wherein the image plane registration correction values for each document page of the exception document are determined based on the estimated image plane registration error information for the corresponding page number.

14. The method of claim 12, further including:

measuring registration errors between image planes for each of the document pages of the printed exception document;

determining image plane registration error information characterizing the registration errors between image planes caused by physical distortions of the print medium as a function of page number within the printed exception document; and adding the determined image plane registration error information to the image plane registration error database in association with the page-count classification of the exception document so that it is available for use with subsequent documents having the same page-count classification.

15. The method of claim 1, wherein the document-type classification corresponds to statements from a financial institution, bills from a service provider, or bulk mailing documents having variable image content.

16. The method of claim 1, wherein documents having a particular document-type classification and a particular page-count classification include at least one graphical element on a particular document page.

17. The method of claim 1, wherein the image plane registration error database stores image plane registration error information for one or more of the most common page-count classifications in a population of documents having the particular document-type classification.

18. The method of claim 1, further including:

determining residual image plane registration errors for each of the document pages of the printed new document; and updating the image plane registration error information stored in the image plane registration error database responsive to the determined residual image plane registration errors.

19. The method of claim 1, wherein a plurality of image plane registration error databases are designated, each associated with a particular document-type classification, and further including selecting the image plane registration error database associated with the document-type classification of the new document.

20. The method of claim 1, further including:

determining a history sub-classification for the new document based on the number of document pages in one or more adjacent documents printed adjacent to the new document;

wherein the image plane registration error database stores image plane registration error information characterizing registration errors between image planes caused by physical distortions of the print medium as a function of page number for each of a plurality of different page-count classifications and history sub-classifications; and wherein the image plane registration correction values are determined for each document page of the new document based on the stored image plane registration error information associated with the determined page-count classification and history sub-classification.

21. The method of claim 20, wherein the one or more adjacent documents include a document printed immediately before the new document or a document printed immediately following the new document.

22. The method of claim 1, wherein the multi-channel printing system is adapted to print in a plurality of print lanes to concurrently print a plurality of document pages, and further including:

determining a print-lane sub-classification for the new document based on the print lane where the first document page of the new document will be printed;

wherein the image plane registration error database stores image plane registration error information characterizing registration errors between image planes caused by physical distortions of the print medium as a function of page number for each of a plurality of different page-count classifications and print-lane sub-classifications; and wherein the image plane registration correction values are determined for each document page of the new document based on the stored image plane registration error information associated with the determined page-count classification and print-lane sub-classification.

23. The method of claim 1, further including:

determining an image-content sub-classification for the new document based on the image content of one or more pages of the new document;

wherein the image plane registration error database stores image plane registration error information characterizing registration errors between image planes caused by physical distortions of the print medium as a function of page number for each of a plurality of different page-count classifications and image-content sub-classifications; and wherein the image plane registration correction values are determined for each document page of the new document based on the stored image plane registration error information associated with the determined page-count classification and image-content sub-classification.

* * * * *